US008967756B2

(12) United States Patent
Ishii et al.

(10) Patent No.: US 8,967,756 B2
(45) Date of Patent: Mar. 3, 2015

(54) PRINTER AND PRINT SYSTEM

(75) Inventors: Hiroyasu Ishii, Shizuoka (JP); Kiyoshi Morino, Shizuoka (JP); Sadayoshi Mochida, Shizuoka (JP); Chikahiro Saegusa, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 167 days.

(21) Appl. No.: 13/450,603

(22) Filed: Apr. 19, 2012

(65) Prior Publication Data

US 2012/0313994 A1 Dec. 13, 2012

(30) Foreign Application Priority Data

Jun. 8, 2011 (JP) ..... 2011-128332

(51) Int. Cl.
*B41J 29/38* (2006.01)
*B41J 2/32* (2006.01)

(52) U.S. Cl.
CPC ..... *B41J 2/32* (2013.01); *B41J 2202/37* (2013.01)
USPC ..... 347/17; 347/5; 347/171; 347/172; 347/191; 347/192; 347/193; 347/194; 347/195; 347/217

(58) Field of Classification Search
None
See application file for complete search history.

(56) References Cited

U.S. PATENT DOCUMENTS

| | | | | |
|---|---|---|---|---|
| 7,215,442 | B2 * | 5/2007 | Yamauchi et al. | 358/1.9 |
| 7,527,345 | B2 * | 5/2009 | Fukuda et al. | 347/9 |
| 8,525,860 | B2 * | 9/2013 | Ishii et al. | 347/214 |
| 2009/0080927 | A1 * | 3/2009 | Fukui | 399/69 |
| 2010/0165063 | A1 * | 7/2010 | Abramovitch | 347/101 |

FOREIGN PATENT DOCUMENTS

| | | |
|---|---|---|
| JP | 07-256965 | 10/1995 |

* cited by examiner

*Primary Examiner* — Manish S Shah
*Assistant Examiner* — Jeremy Delozier
(74) *Attorney, Agent, or Firm* — Amin, Turocy & Watson, LLP

(57) ABSTRACT

According to one embodiment, a printer includes an image forming unit, a coloring conversion unit, and a deterring unit. The image forming unit forms an image from a temperature-sensitive ink whose color is changed depending on a temperature on a medium. The coloring conversion unit converts a coloring state of the image of the temperature-sensitive ink by heating or cooling the image of the temperature-sensitive ink. The deterring unit provided between the coloring conversion unit and the image forming unit deters an air heated or cooled by the coloring conversion unit from flowing toward the image forming unit.

18 Claims, 26 Drawing Sheets

PRINTER AND PRINT SYSTEM

CROSS-REFERENCE TO RELATED APPLICATION

This application is based upon and claims the benefit of priority from Japanese Patent Application No. 2011-128332, filed on Jun. 8, 2011, the entire contents of which is incorporated herein by reference.

FIELD

Embodiments described herein relate generally to a printer, a print system and a printing method.

BACKGROUND

Some thermal printers form an image by melting an ink of an ink ribbon with the heat of a thermal head and thermally transfers the ink to a medium.

However, this kind of printer suffers from a problem in that the image formation quality is reduced if the environmental temperature around the thermal head and the ink ribbon changes sharply.

DETAILED DESCRIPTION

According to one embodiment, a printer includes an image forming unit, a coloring conversion unit, and a deterring unit. The image forming unit forms an image from a temperature-sensitive ink whose color is changed depending on a temperature on a medium. The coloring conversion unit converts a coloring state of the image of the temperature-sensitive ink by heating or cooling the image of the temperature-sensitive ink. The deterring unit provided between the coloring conversion unit and the image forming unit deters an air heated or cooled by the coloring conversion unit from flowing toward the image forming unit.

Certain embodiments will now be described in detail with reference to the drawings.

Figure 1:
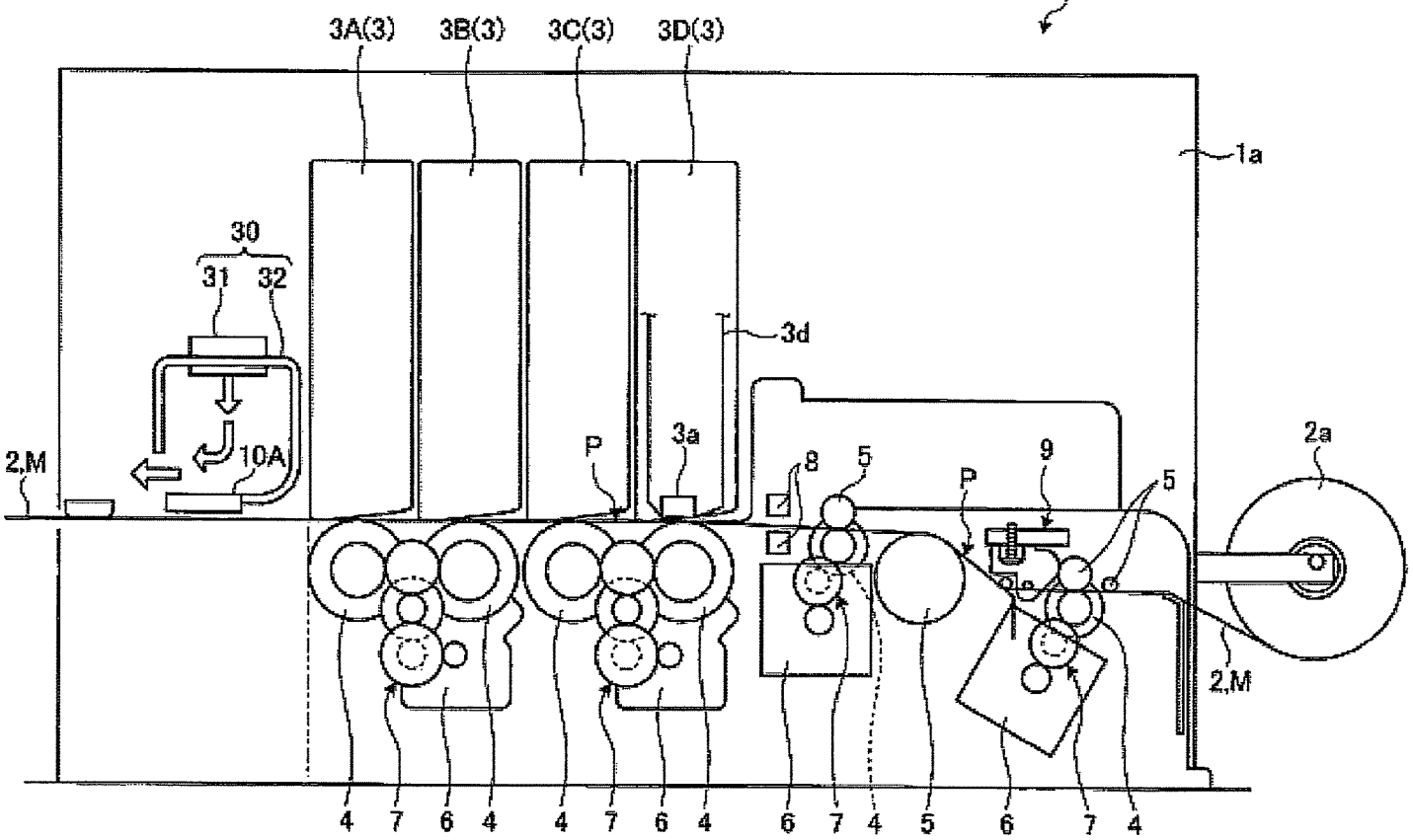
FIG. 1 is a side view showing a schematic configuration of a printer according to a first embodiment.

FIG. 1 is a side view showing a schematic configuration of a printer 1 according to a first embodiment.

The printer 1 of the present embodiment is made up of, e.g., a thermal printer configured to heat an ink ribbon and transfer ink to a medium M such as paper.

Figure 8A:
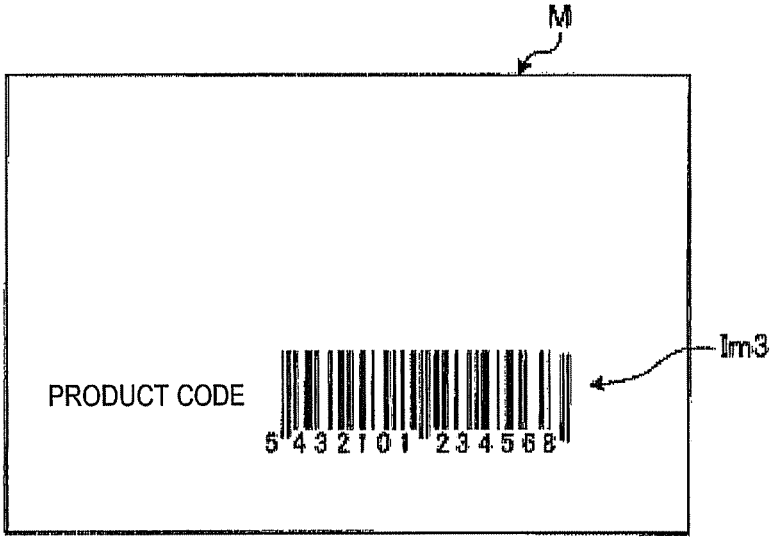
FIGS. 8A and 8B are views showing one example of a product label as a medium obtained in the printer.
Figure 8B:
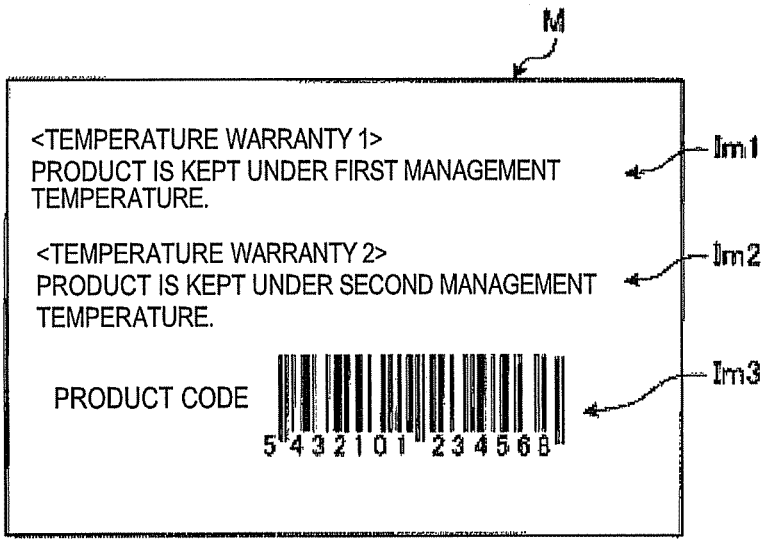

The medium M used in the present embodiment may be, e.g., a label shown in FIGS. 8A and 8B. A plurality of media M is attached to, e.g., a surface of a strip-shaped backing paper 2 at a specified interval (pitch).

As shown in FIG. 1, the printer 1 includes a body unit 1*a* to which a plurality of (four, in the present embodiment) ink ribbon cartridges 3 (3A through 3D) can be attached in a removable manner. The ink ribbon cartridges 3 are arranged side by side along a conveyance path P of the strip-shaped backing paper 2 defined inside the printer 1.

Each of the ink ribbon cartridges 3 includes a head (thermal head) 3*a* and an ink ribbon 3*d*. By causing the head 3*a* to heat the ink of the ink ribbon 3*d*, each of the ink ribbon cartridges 3 forms images of different inks on the medium M conveyed along the conveyance path P.

In the printer 1 of the present embodiment, the head (thermal head) 3*a* of each of the ink ribbon cartridges 3 corresponds to an image forming unit.

The number of ink ribbon cartridges 3 is not limited to four but may be set differently.

A roll 2*a* of the backing paper 2 is removably and rotatably mounted to the body unit 1*a* at the most upstream side of the conveyance path P. Upon rotation of conveying rollers 4, the backing paper 2 is drawn away from the roll 2*a* and conveyed through the conveyance path P. The conveyance path P is defined not only by the arrangement of the ink ribbon cartridges 3 but also by the arrangement of conveying rollers 4 and auxiliary rollers 5.

The printer 1 includes a plurality of conveying rollers 4 rotationally driven by a motor 6. Rotation of the motor 6 is transmitted to the respective conveying rollers 4 through a rotation-transmitting mechanism (or a speed-reducing mechanism) 7. The printer 1 includes auxiliary rollers 5 arranged in such positions that the auxiliary rollers 5 nip the backing paper 2 in cooperation with the conveying rollers 4 or in such positions that the backing paper 2 is stretched between the conveying rollers 4 or between the auxiliary rollers 5.

The printer 1 further includes a sensor 8 for detecting the medium M and a tension detecting mechanism 9 for detecting the tension of the backing paper 2.

In the printer 1 of the present embodiment, the conveying rollers 4, the auxiliary rollers 5, the motor 6 and the rotation-transmitting mechanism 7 make up a conveying mechanism for conveying the backing paper 2 (or the medium M).

The printer 1 can be mounted with an ink ribbon cartridge 3 having an ink ribbon of a non-temperature-sensitive ink whose color does not change depending on temperature, an ink ribbon cartridge 3 having an ink ribbon of temperature-sensitive ink whose color changes depending on the temperature and an ink ribbon cartridge 3 having a differently-colored ink ribbon (of a non-temperature-sensitive ink and a temperature-sensitive ink).

Each of the ink ribbon cartridges 3 can be removably mounted in one of the mounting positions of the ink ribbon cartridges 3 (3A through 3D) provided in the body unit 1*a*.

Figure 2A:
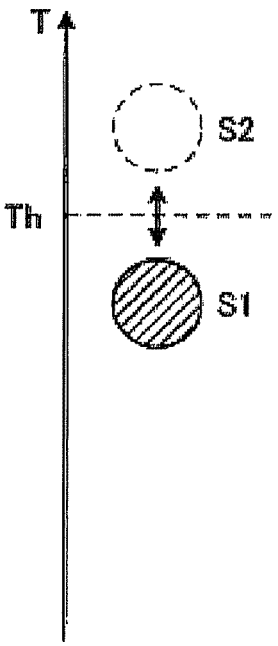
FIGS. 2A and 2B are views illustrating one example of the temperature-sensitive properties of a temperature-sensitive ink.

Among the temperature-sensitive inks is an ink whose coloring state varies above and below a threshold temperature Th as depicted in FIG. 2A.

For example, the temperature-sensitive ink depicted in FIG. 2A becomes white (S2) if the temperature T exceeds the threshold temperature Th but gets colored (S1) if the temperature T is equal to or lower than the threshold temperature Th. If the medium M is white in color and if the temperature-sensitive ink remains white (S2), the temperature-sensitive ink images formed on the medium M are hard to see or invisible. The temperature-dependent change of the coloring state of the temperature-sensitive ink is reversible.

Figure 2B:
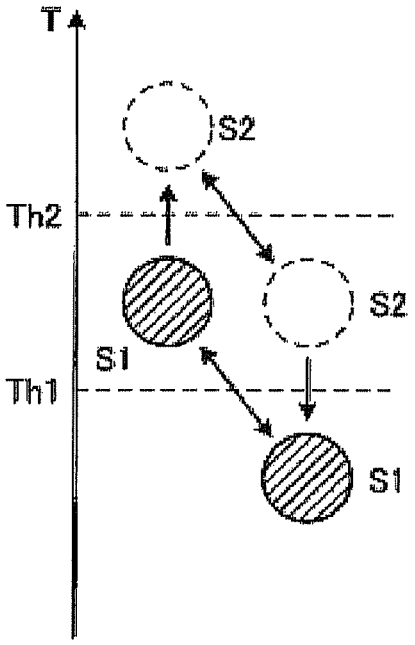

Among the temperature-sensitive inks, there is also an ink whose coloring state varies above and below two different threshold temperatures Th1 and Th2 when the temperature T goes up and down as depicted in FIG. 2B.

For example, the temperature-sensitive ink depicted in FIG. 2B remains white (S2) if the temperature T, when going down, is higher than a first threshold temperature Th1 but gets colored (S1) if the temperature T, when going down, becomes equal to or lower than the first threshold temperature Th1. If the medium M has a white color and if the temperature-sensitive ink remains white (S2), the temperature-sensitive ink images formed on the medium M are hard to see or invisible. The temperature-sensitive ink depicted in FIG. 2B remains colored (S1) if the temperature T, when going up, is equal to or lower than a second threshold temperature Th2 but becomes white (S2) if the temperature T, when going up, is higher than the second threshold temperature Th2.

In this regard, the second threshold temperature Th2 is higher than the first threshold temperature Th1 as can be seen in FIG. 2B. Therefore, as long as the temperature T stays between the first threshold temperature Th1 and the second threshold temperature Th2, the coloring state of the temperature-sensitive ink in the falling process of the temperature T differs from the coloring state of the temperature-sensitive ink in the rising process of the temperature T.

Since many different kinds of temperature-sensitive inks are available, it is possible to appropriately change the threshold temperatures Th, Th1 and Th2 and the colors in the respective coloring states.

In the case of a thermal printer, the temperature T goes up during an image forming process (heat transfer process). Therefore, if images of a temperature-sensitive ink whose color is changed to the same color as the medium M at a temperature higher that the threshold temperatures Th, Th1 and Th2 mentioned above are formed on the medium M through the use of the printer 1, it is often impossible or difficult to determine whether the temperature-sensitive ink images are successfully formed on the medium M. Depending on the kinds of temperature-sensitive inks, it is sometimes the case that the temperature-sensitive ink images formed on the medium M are hardly visible at normal temperature.

In view of this, the printer 1 of the present embodiment includes a cooling device 10A that serves as a coloring conversion mechanism for converting the coloring state of temperature-sensitive ink images formed on the medium M.

In the present embodiment, the temperature T is reduced by, e.g., cooling the temperature-sensitive ink images with the cooling device 10A. Thus, the temperature-sensitive ink images become readily visible, thereby making it easy to check the formation situation of the temperature-sensitive ink images on the medium M.

In other words, the cooling device 10A may be said to be a coloring conversion mechanism or a visualizing mechanism of temperature-sensitive ink images.

In the present embodiment, a Peltier element (or a thermomodule) that can perform cooling through the use of a Peltier effect is employed as the cooling device 10A.

The printer 1 of the present embodiment further includes deterring unit 30. The deterring unit 30 and the cooling device 10A as a coloring conversion unit are arranged at the downstream side of the ink ribbon cartridges 3 as an image forming unit along the conveying direction of the medium M. The deterring unit 30 serves to deter at least a part of the air cooled by the cooling device 10A from reaching the ink ribbon cartridges 3 (the heads 3*a* and the ink ribbons 3*d*) as an image forming unit and the environmental temperature sensor 8 or from staying in a specific area. The deterring unit 30 is supported on the body unit 1*a* by, e.g., a support member (not shown) arranged inside the body unit (housing) 1*a*. In other words, the printer 1 of the present embodiment is characterized by providing the cooling device 10A as a coloring conversion mechanism so that visual recognition of the image of the temperature-sensitive ink can be increased and further provides deterring unit 30 so that the temperature of the ink ribbon cartridge 3 can be constantly maintained without being affected by the cooling device 10A, which is important in maintaining superior printing capability. Further, as described below, the cooling device 10A, which is not limited to the present embodiment and may be provided in various forms, has a superior effect of more easily controlling air flow in the present embodiment.

Figure 3:
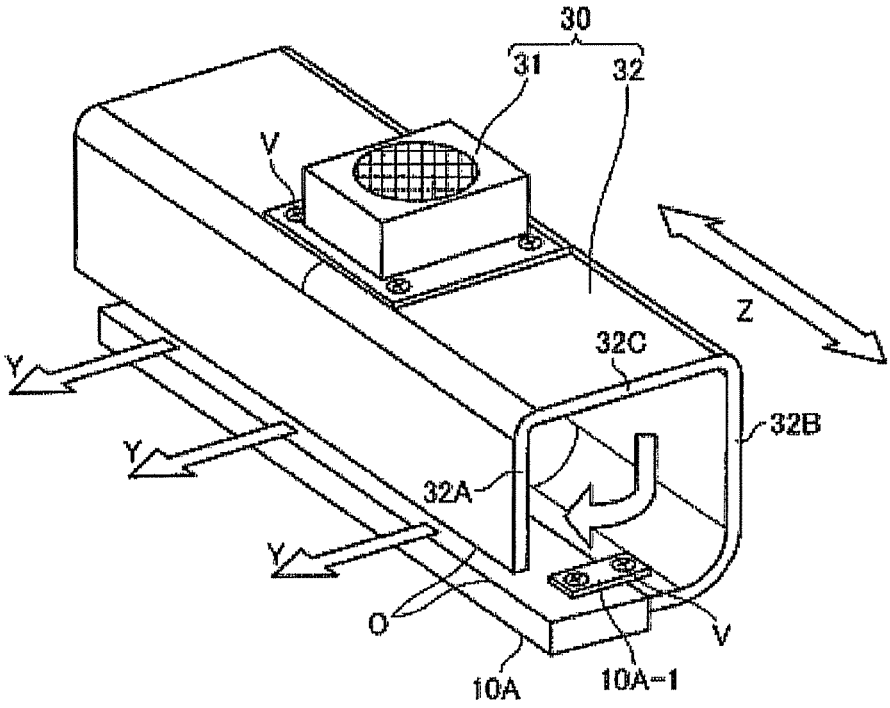
FIG. 3 is an assembled perspective view showing a deterring unit in an assembled state.
Figure 4:
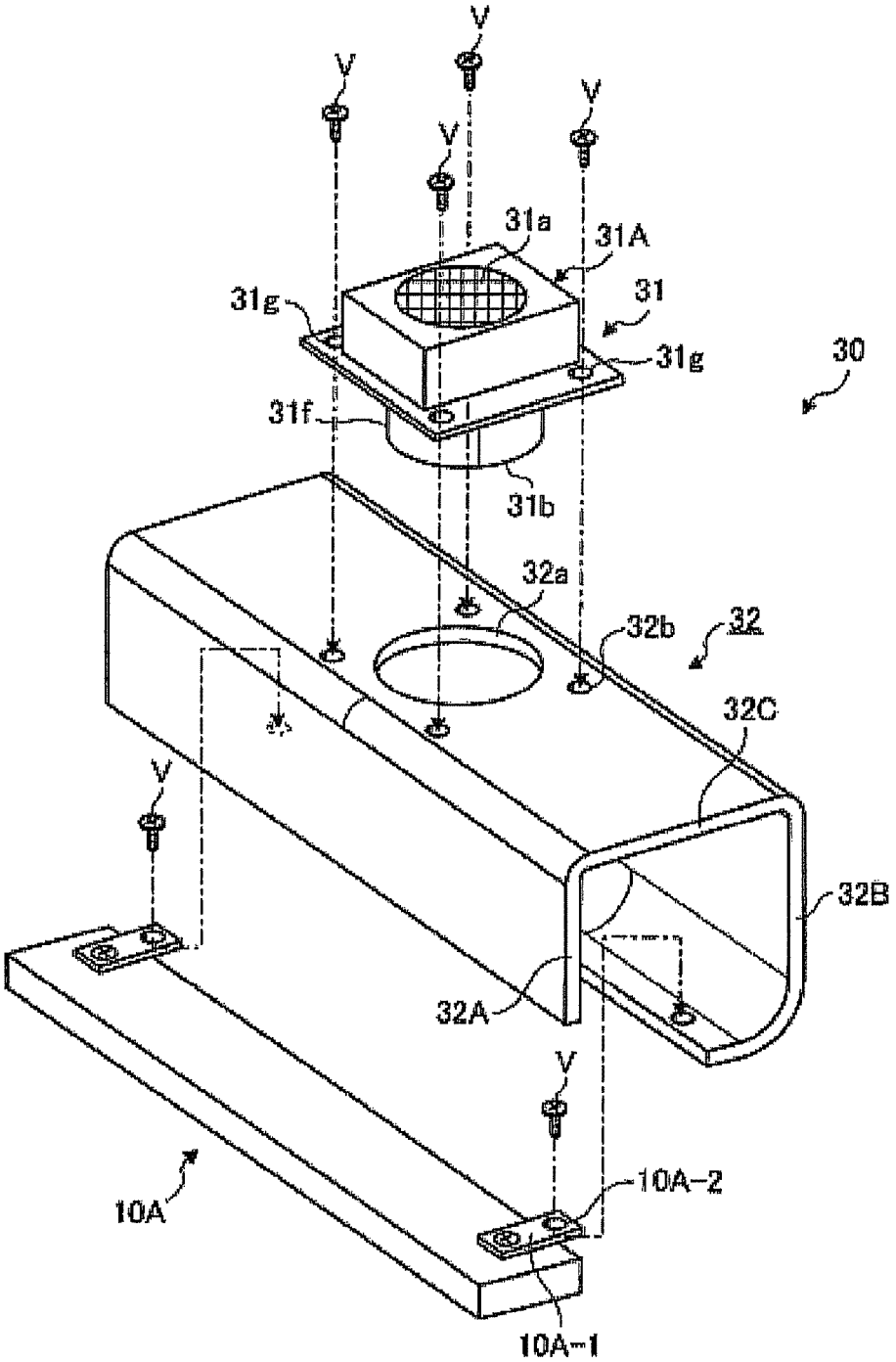
FIG. 4 is an exploded perspective view showing the deterring unit in an exploded state.
Figure 5:
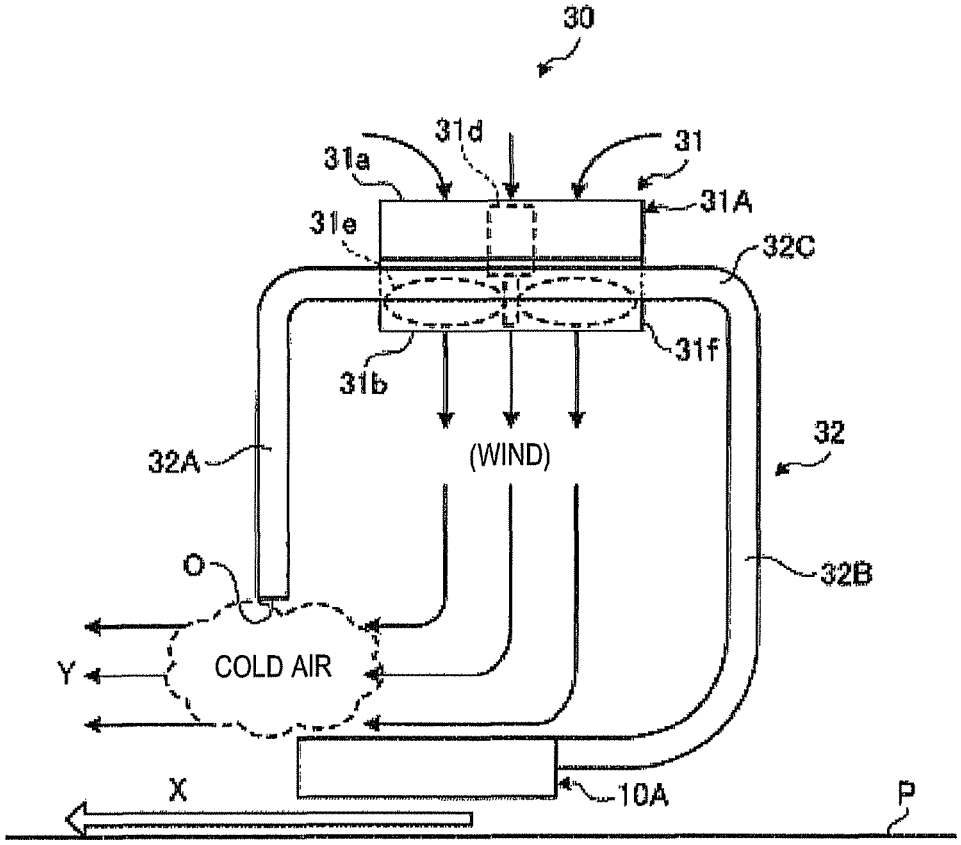
FIG. 5 is a side view of the deterring unit shown in FIG. 3.

FIGS. 3 through 5 are views for explaining the configuration of the deterring unit 30. FIG. 3 is an assembled perspective view showing the deterring unit 30 in an assembled state. FIG. 4 is an exploded perspective view showing the deterring unit 30 in an exploded state. FIG. 5 is a side view of the deterring unit 30 shown in FIG. 3.

As shown in FIGS. 3 through 5, the deterring unit 30 includes a blower unit (or a fan motor) 31 for blowing the air cooled by the cooling device 10A and a guide unit 32 for guiding the air blown by the blower unit 31 so as not to reach the ink ribbon cartridges 3.

The blower unit 31 includes, e.g., a fan case 31A having an air intake surface 31*a* and an air exhaust surface 31*b* arranged at the opposite ends thereof. Within the fan case 31A, there are arranged a blower unit controller 31*c* (see FIG. 6), a motor 31*d* electrically connected to the blower unit controller 31*c* and a fan 31*e* rotationally driven about an axis by the motor 31*d*.

The blower unit 31 includes a cylindrical case portion 31*f* for accommodating the fan 31*e*. The case portion 31*f* is inserted into an insertion hole 32*a* formed on one surface (the upper surface) of the guide unit 32. The blower unit 31 is fixed to a top surface portion 32C of the guide unit 32 by screws V threadedly coupled to screw holes 31*g* formed in the fan case 31A and screw holes 32*b* formed in the guide unit 32.

The guide unit 32 is a member shaped to define a guide route along which the air blown by the blower unit 31 is guided toward the downstream side in a conveying direction X of the medium M (particularly, toward a discharge port (not shown) for the discharge of the medium M formed in the body unit 1*a* at the downstream side of the conveyance path P in the conveying direction X). The guide unit 32 is also a member for holding the cooling device 10A. The guide unit 32 is made of, e.g., a metallic material or a resin material.

More specifically, the guide unit 32 includes a front wall portion 32A arranged near the downstream end of the conveyance path P in the conveying direction X (near the discharge port of the medium M not shown), a rear wall portion 32B arranged in opposing relationship with the front wall portion 32A and a top surface portion 32C configured to interconnect the front wall portion 32A and the rear wall portion 32B and arranged above the conveyance path P to extend parallel to a conveying plane of the conveyance path P. As can be seen in FIG. 5, the guide unit 32 is formed to have a generally trough-like side cross section.

In the present embodiment, the rear wall portion 32B of the guide unit 32 of the deterring unit 30 is provided between the cooling device 10A as a coloring conversion unit and the ink ribbon cartridges 3 as an image forming unit so that the deterring unit 30 can deter at least a part of the air cooled by the cooling device 10A from flowing toward the ink ribbon cartridges 3.

The length of the guide unit 32 in a width direction Z is substantially equal to the width of the conveyance path P. The guide unit 32 is arranged close to one surface (the upper surface) of the conveyance path P in alignment with the width of the conveyance path P.

In other words, the guide unit 32 having the shape set forth above guides the air (wind) blown by the fan 31*e* of the blower unit 31 toward the cooling device 10A arranged below the fan 31*e* and discharges at least a part of the air (cold air) cooled by the cooling device 10A from an outlet O defined between the front wall portion 32A and the upper surface of the cooling device 10A.

The cooling device 10A is fixed to the guide unit 32 by connector members 10A-1 and screws V threadedly coupled to screw holes 10A-2 of the connector members 10A-1.

Although not particularly shown in the drawings, it may be possible to provide a guide wall portion extending from an open end (lower end) of the front wall portion 32A of the guide unit 32 to the discharge port (not shown) of the medium M formed in the body unit 1*a* in a generally parallel relationship with the conveying plane of the conveyance path P.

Although not particularly shown in FIGS. 1 and 3 through 5, in some embodiments the opposite open ends in the width direction Z of the guide unit 32 (see FIG. 3) are closed by the opposite side wall portions (not shown) in the width direction Z of the body unit 1*a* or are connected to vent holes (not shown) formed in the opposite side wall portions (not shown) of the body unit 1*a*. This makes it possible to deter the cold air leaked from the opposite open ends in the width direction Z of the guide unit 32 from flowing toward the ink ribbon cartridges 3 as an image forming unit.

Figure 6:
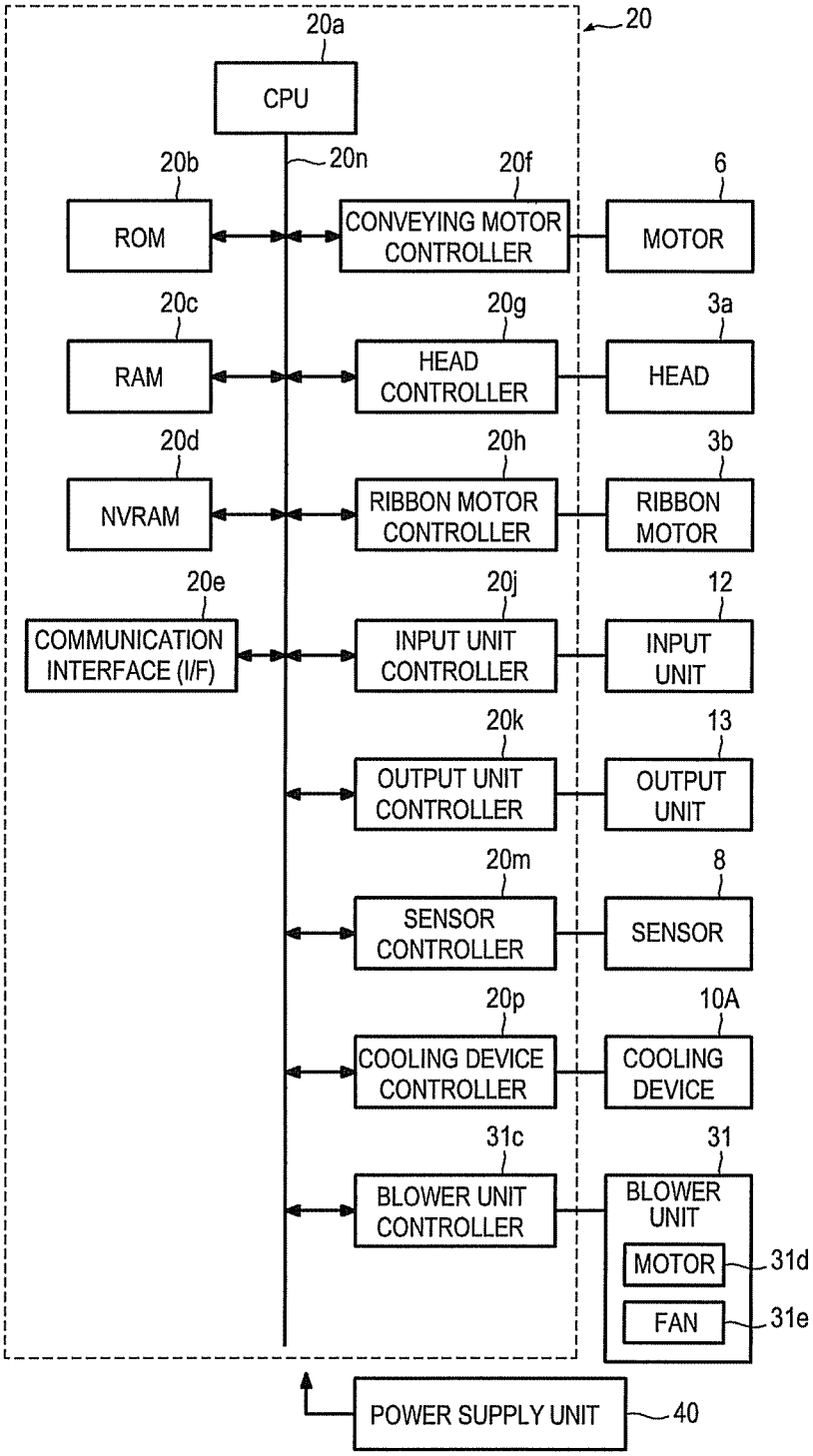
FIG. 6 is a block diagram showing a hardware configuration of a control system of the printer according to the first embodiment.

FIG. 6 is a block diagram showing a hardware configuration of the printer 1 of the present embodiment, particularly the details of a control circuit 20 as a control system.

Referring to FIG. 6, the control circuit 20 of the printer 1 includes a CPU (Central Processing Unit) 20*a* as a control unit, a ROM (Read Only Memory) 20*b*, a RAM (Random Access Memory) 20*c*, an NVRAM (Non-Volatile Random Access Memory) 20*d*, a communication interface (I/F) 20*e*, a conveying motor controller 20*f*, a head controller 20*g*, a ribbon motor controller 20*h*, an input unit controller 20*j*, an output unit controller 20*k*, a sensor controller 20*m*, a cooling device controller 20*p* and a blower unit controller 31*c*, all of which are connected to one another through a bus 20*n* such as an address bus or a data bus.

The CPU 20*a* controls individual units of the printer 1 by executing various kinds of computer-readable programs stored in the ROM 20*b* or other places. The ROM 20*b* stores, e.g., various kinds of data processed by the CPU 20*a* and various kinds of programs (such as a basic input/output system abbreviated as BIOS, an application program and a device driver program) executed by the CPU 20*a*. The RAM 20*c* temporarily stores data and programs while the CPU 20*a* executes various kinds of programs. The NVRAM 20*d* stores, e.g., an OS (Operating System), an application program, a device driver program and various kinds of data which are to be kept intact even when the power is turned off.

The communication interface (I/F) 20*e* controls data communication with other devices connected through telecommunication lines.

The conveying motor controller 20*f* controls the motor 6 pursuant to an instruction supplied from the CPU 20*a*. The head controller 20*g* controls the head 3*a* (see FIG. 1) in response to an instruction supplied from the CPU 20*a*. The ribbon motor controller 20*h* controls a ribbon motor 3*b* provided in each of the ink ribbon cartridges 3 according to an instruction supplied from the CPU 20*a*.

The input unit controller 20*j* transmits to the CPU 20*a* signals inputted through an input unit 12 for inputting manual operations or voices of a user (e.g., push buttons, a touch panel, a keyboard, a microphone, knobs or DIP switches). The output unit controller 20*k* controls an output unit 13 for outputting images or voices (e.g., a display, a light-emitting unit, a speaker or a buzzer) pursuant to an instruction supplied from the CPU 20*a*.

The sensor controller 20*m* transmits to the CPU 20*a* signals indicative of the detection results of sensors 8 including various kinds of sensors such as an environmental temperature sensor. In the printer 1 of the present embodiment, the environmental temperature sensor (8) is arranged near the ink ribbon cartridges 3 and at the upstream side of the deterring unit 30 and the cooling device 10A in the conveying direction X.

Pursuant to an instruction received from the CPU 20*a*, the cooling device controller 20*p* controls the electric power supplied to the cooling device (Peltier element) 10A, thereby controlling the cooling operation of the cooling device (Peltier element) 10A.

Responsive to an instruction received from the CPU 20*a*, the blower unit controller 31*c* controls the operation of the motor 31*d*, thereby controlling the rotation of the fan 31*e* of the blower unit 31.

The printer 1 of the present embodiment includes a power supply unit 40 for supplying necessary electric power from a commercial power source to the respective loads (e.g., the control circuit 20, the cooling device 10A and the motor 31*d* of the blower unit 31).

Figure 7:
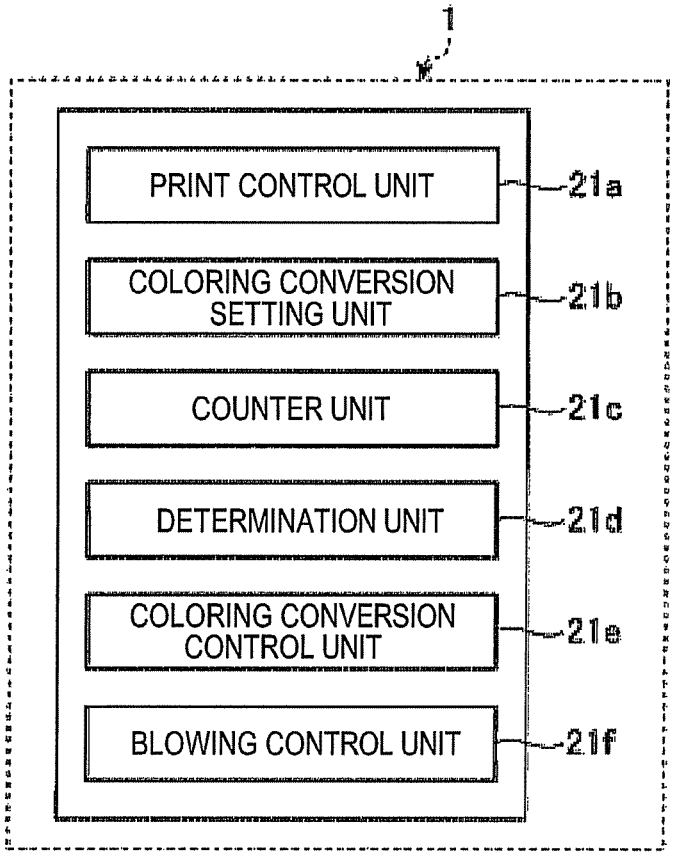
FIG. 7 is a block diagram showing a software configuration of the printer according to the first embodiment.

FIG. 7 is a block diagram for explaining a functional configuration (software configuration) of the printer 1 realized when the programs stored in the ROM 20*b* are expanded onto the RAM 20*c* and executed by the CPU 20*a*.

As shown in FIG. 7, the CPU 20*a* as a control unit works as the print control unit 21*a*, the coloring conversion setting unit 21*b*, the counter unit 21*c*, the determination unit 21*d*, the coloring conversion control unit 21*e* and the blowing control unit 21*f* according to the programs. The programs include modules corresponding to at least the print control unit 21*a*, the coloring conversion setting unit 21*b*, the counter unit 21*c*, the determination unit 21*d*, the coloring conversion control unit 21*e* and the blowing control unit 21*f*.

The print control unit 21*a* controls the motor 6, the head 3*a* and the ribbon motor 3*b* through the conveying motor controller 20*f*, the head controller 20*g* and the ribbon motor controller 20*h*. Images such as letters or pictures are formed on the medium M under the control of the print control unit 21*a*.

The coloring conversion setting unit 21*b* performs various kinds of setting operations associated with the coloring conversion of the temperature-sensitive ink images formed on the medium M (the cooling performed by the cooling device 10A in the present embodiment). More specifically, the coloring conversion setting unit 21*b* can cause the storage unit such as the NVRAM 20*d* to store a pitch (frequency) at which coloring conversion (cooling) is performed with respect to the media M and a parameter for setting the operation conditions of the cooling device 10A (e.g., the cooling timing and the cooling time period), which are inputted through the input unit 12.

The counter unit 21*c* counts the number of media M (or the number of image formation areas) detected by the sensor 8.

The determination unit 21*d* compares the count value counted by the counter unit 21*c* with the pitch (frequency) stored in the storage unit and determines whether to perform coloring conversion (cooling in the present embodiment).

The coloring conversion control unit 21*e* controls the operation of the cooling device 10A in order to perform coloring conversion (cooling) with respect to the medium M (the temperature-sensitive ink images formed on the medium M) which is determined by the determination unit 21*d* to be subjected to coloring conversion. In the present embodiment, pursuant to the setting of the pitch (frequency), the coloring conversion can be performed with respect to the temperature-sensitive ink images formed on all the media M or some of the media M.

The blowing control unit 21*f* controls the operation of the motor 31*d* of the blower unit 31 to deter at least a part of the air (cold air) cooled by the cooling device 10A from staying around the cooling device 10A or flowing toward the ink ribbon cartridges 3 as an image forming unit when coloring conversion (cooling) is performed by the coloring conversion control unit 21*e*.

In the present embodiment, the coloring conversion control unit 21*e* and the blowing control unit 21*f* are configured to switch, under the control of the CPU 20*a*, the operations of the cooling device 10A and the blower unit 31 to one of an intermittent operation and a continuous operation depending on the image formation interval.

Under the control of the CPU 20*a*, the blowing control unit 21*f* stops the operation of the blower unit 31 (the rotation of the motor 31*d*) if a specified times lapses after the operation of the cooling device 10A as a coloring conversion unit is stopped.

In other words, the cooling device 10A remains cold for a specified time after the stoppage of the operation thereof. Thus, the blower unit 31 is continuously operated for the specified time after the stoppage of the operation of the cooling device 10A. This makes it possible to deter at least a part of the air (cold air) cooled by the cooling device 10A from staying around the cooling device 10A or flowing toward the ink ribbon cartridges 3 as an image forming unit.

In the printer 1 configured as above, it is possible to obtain, e.g., a medium M as illustrated in FIG. 8A or 8B.

FIG. 8A illustrates a product label as a medium M outputted from the printer 1 with no cooling performed by the cooling device 10A. FIG. 8B illustrates a product label as a medium M outputted from the printer 1 with the cooling performed by the cooling device 10A.

As illustrated in FIG. 8B, the temperature-sensitive ink images Im1 and Im2 are visualized when the cooling is performed by the cooling device 10A. Accordingly, as user or an operator of the printer 1, it is easy to visually recognize the formation of the temperature-sensitive ink images Im1 and Im2 on the medium M.

FIGS. 8A and 8B illustrate a case where images Im1 and Im2 of two kinds of temperature-sensitive inks differing in threshold temperature Th are formed on the medium M. Moreover, an image Im3 (e.g., a barcode) formed by a typical ink whose coloring state is not changed depending on a temperature is also formed on the medium M.

As one example, the medium M illustrated in FIGS. 8A and 8B can be used for temperature management when refrigerating or freezing a product.

More specifically, the medium M on which the images Im1 and Im2 of the temperature-sensitive ink having the temperature-sensitive property depicted in FIG. 2A are formed by the printer 1 is used as a product label. The printer 1 utilizes a temperature-sensitive ink having a threshold temperature Th equal to a management temperature (e.g., 5 degrees C.) that a product to be refrigerated or frozen is not allowed to exceed. As a result, if a product temperature exceeds the threshold temperature Th, the medium M comes into the state as illustrated in FIG. 8A. Thus, the temperature-sensitive ink images Im1 and Im2 become hard to see or invisible (S2 in FIG. 2A).

On the other hand, if the product temperature is equal to or lower than the threshold temperature Th as the management temperature, the medium M is kept in the state illustrated in FIG. 8B (S1 in FIG. 2A). This enables a worker or other persons to determine whether the product temperature is higher than or lower than the management temperature, depending on whether the temperature-sensitive ink images Im1 and Im2 are easy to see (visible) or hard to see (invisible).

In the example illustrated in FIGS. 8A and 8B, the images Im1 and Im2 of two kinds of temperature-sensitive inks differing in the threshold temperature Th are formed on the medium M to thereby indicate the product management results with respect to the two kinds of management temperatures (first and second management temperatures). In this example, the formation condition of the temperature-sensitive ink images Im1 and Im2 on the medium M can be visually recognized by cooling the medium M with the cooling device 10A.

As another example, images Im1 and Im2 of a temperature-sensitive ink with a temperature-sensitive property showing a hysteresis in temperature rising and falling processes as depicted in FIG. 2B can be formed by the printer 1 on a product label as a medium M illustrated in FIGS. 8A and 8B.

In this case, the printer 1 forms the images Im1 and Im2 on the medium M through the use of a temperature-sensitive ink having a threshold temperature Th2 equal to a management temperature (e.g., −5 degrees C.) that a product to be refrigerated or frozen is not allowed to exceed and a threshold temperature Th1 equal to a temperature (e.g., −30 degrees C.) that cannot be realized in a specified refrigerating or freezing state.

In the printer 1, the cooling device 10A cools the images Im1 and Im2 to the threshold temperature Th1 or less (e.g., −40 degrees C.) so that the images Im1 and Im2 formed by the printer 1 can be visualized on the medium M.

In this example, all the media M are cooled by the cooling mechanism 10 to first reduce the temperature of the media M to the threshold temperature Th1 or less. As a result, if a product temperature exceeds the threshold temperature Th2 as the management temperature even just once, the medium M comes into the state as illustrated in FIG. 8A. Thus, the temperature-sensitive ink images Im1 and Im2 become hard to see or invisible (S2 in FIG. 2B) and continue to remain in this state (S2).

On the other hand, if the product temperature is equal to or lower than the threshold temperature Th2 as the management temperature, the medium M is kept in the state illustrated in FIG. 8B (S1 in FIG. 2B). This enables a worker or other persons to determine whether the product temperature has ever exceeded the management temperature before, depending on whether the temperature-sensitive ink images Im1 and Im2 are easy to see (visible) or hard to see (invisible).

In this example, the images Im1 and Im2 of two kinds of temperature-sensitive inks differing in the threshold temperature Th2 are formed on the medium M to thereby indicate the product management results with respect to the two kinds of management temperatures (first and second management temperatures).

According to the present embodiment described above, it is possible to deter at least a part of the air (cold air) cooled by the cooling device 10A from flowing toward (or reaching) the ink ribbon cartridges 3 (the heads 3*a* and the ink ribbons 3*d*) as an image forming unit and the environmental temperature sensor (8). This helps restrain or prevent the occurrence of a sharp change in the environmental temperature detected by the environmental temperature sensor (8). Accordingly, it is possible to accurately control the heating operation of the head 3*a* and to restrain or prevent the temperature-sensitive ink from being unnecessarily hardened. Moreover, it is possible to prevent reduction of an image formation quality (print quality).

According to the present embodiment, the deterring unit 30 (including the blower unit 31 and the guide unit 32) can deter at least a part of the air (cold air) cooled by the cooling device 10A from staying in a specific area (e.g., around the cooling device 10A), which helps prevent the occurrence of dew condensation in the body unit 1*a*. This makes it possible to prevent the conveyance path P and the medium M from getting wet and to prevent the finger or the hand of an operator from getting wet when touching the body unit 1*a*.

While one illustrative embodiment has been described above, the present disclosure is not limited to this embodiment.

The embodiment described above is directed to an all-in-one printer 1 in which the ink ribbon cartridges 3 as an image forming unit, the cooling device 10A as a coloring conversion unit and the deterring unit 30 (including the blower unit 31 and the guide unit 32) are accommodated within the body unit 1*a*. However, the present disclosure is not limited thereto. Alternatively, it may be possible to provide a print system in which the respective components (particularly, the image forming unit and the coloring conversion unit) are arranged independently of each other.

Figure 9:
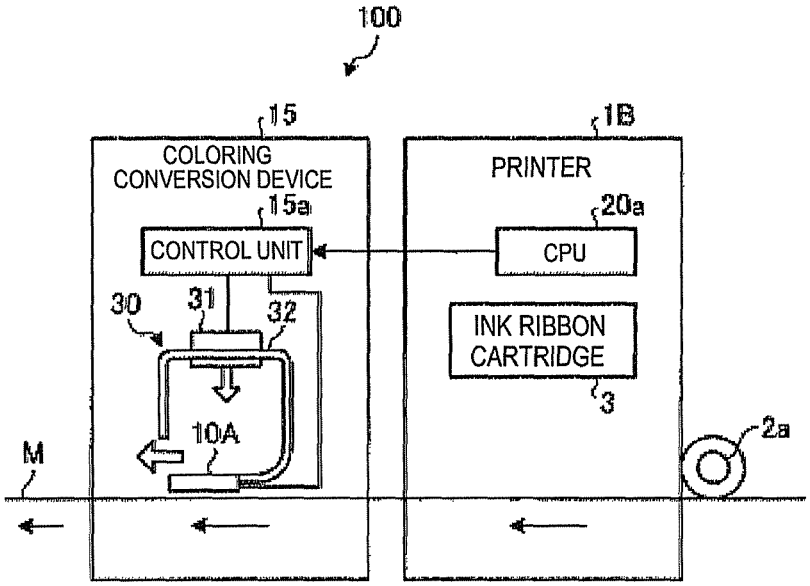
FIG. 9 is a side view showing a schematic configuration of a print system.

More specifically, as shown in FIG. 9, it may be possible to provide a print system 100 including a printer 1B and a coloring conversion device 15. The printer 1B includes a CPU 20*a*, a plurality of ink ribbon cartridges 3 as an image forming unit capable of forming, on a medium M, images of a temperature-sensitive ink whose color changes depending on temperature, and a conveying unit which includes conveying rollers 4, auxiliary rollers 5, a motor 6 and a rotation-transmitting mechanism (or a speed-reducing mechanism) 7. The coloring conversion device 15 includes a control unit 15*a* for receiving a control signal issued from the CPU 20*a*, a coloring conversion unit (e.g., a cooling device 10A) for heating or cooling the images formed by the image forming unit of the printer 1B and converting the coloring states of the images under the control of the control unit 15*a* and a deterring unit 30 for deterring at least a part of the air heated or cooled by the coloring conversion unit from flowing toward the image forming unit or staying in a specific area.

In the print system 100, if the printer 1B and the coloring conversion device 15 are arranged close to each other, the deterring unit 30 can provide an enhanced effect of deterring at least a part of the air heated or cooled by the coloring conversion unit from flowing toward the image forming unit.

Figure 10:
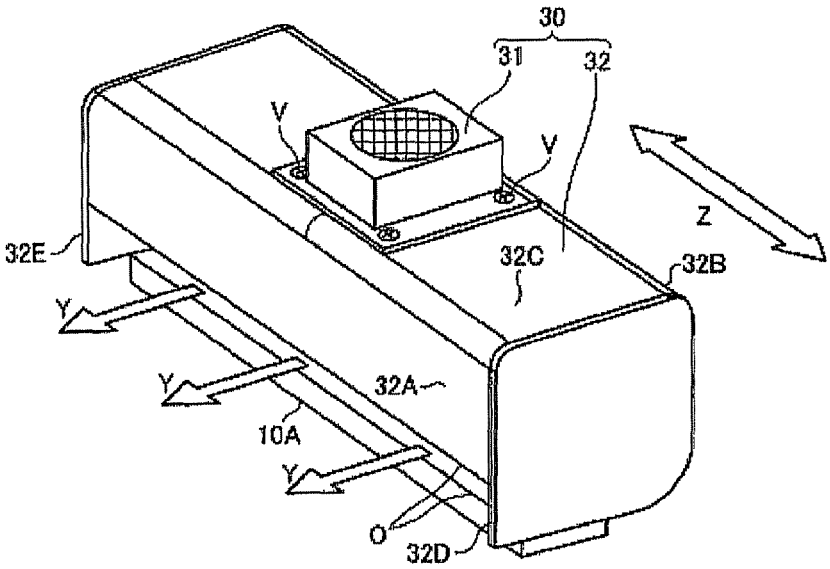
FIG. 10 is a perspective view showing a modified example of the deterring unit shown in FIG. 3.

In the embodiment described above, as shown in FIG. 3, the guide unit 32 has no wall at the opposite ends in the width direction Z and engages with the body unit 1*a*. Alternatively, as illustrated in FIG. 10, the guide unit 32 may have side wall portions 32D and 32E at the opposite ends thereof. As compared with the guide unit 32 shown in FIG. 3, this configuration makes it possible to more accurately deter at least a part of the air (cold air) cooled by the cooling device 10A from flowing toward the ink ribbon cartridges 3 as an image forming unit.

Figure 11:
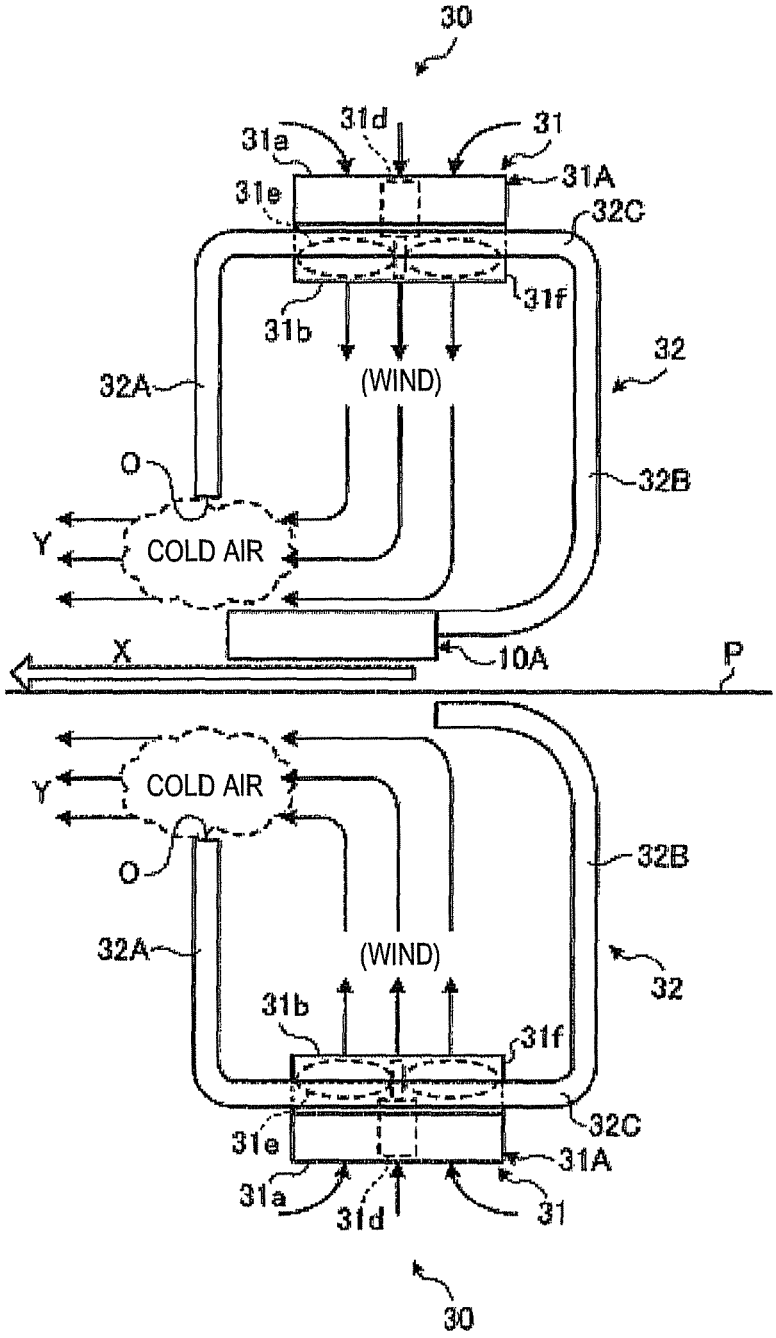
FIG. 11 is a side view showing a modified example of the printer shown in FIG. 1.

In the embodiment described above, as shown in FIG. 1, the deterring unit 30 is arranged on one surface (the upper surface) of the cooling device 10A, namely on one surface (the upper surface) of the conveyance path P. Alternatively, as illustrated in FIG. 11, an additional deterring unit 30 may be arranged on the other surface (the lower surface) of the cooling device 10A, namely on the other surface (the lower surface) of the conveyance path P.

This configuration can deter at least a part of the cold air generated below the cooling device 10A and the conveyance path P from flowing toward the ink ribbon cartridges 3 (the heads 3*a* and the ink ribbons 3*d*) as an image forming unit or from staying at the lower side of the cooling device 10A and the conveyance path P.

As another alternative example, only an additional guide unit 32 for deterring at least a part of the cold air generated below the cooling device 10A and the conveyance path P from flowing toward the ink ribbon cartridges 3 as an image forming unit may be arranged below the cooling device 10A and the conveyance path P without installing any blower unit 31. In this case, the shape of the additional guide unit 32 is not limited to the generally trough-like shape but may be a flat plate shape orthogonal to the conveying surface of the conveyance path P or other shapes.

In the embodiment described above, the printer 1 employs a cooling device (the cooling device 10A) for cooling the images formed on the medium M as the coloring conversion unit for converting the coloring states of the images formed on the medium M. However, the present disclosure is not limited thereto. Alternatively, it may be possible to provide a printer 1 that employs, as the coloring conversion unit, a heating device for heating the images formed on the medium M.

In the printer 1 including the heating device stated above, the deterring unit 30 can deter at least a part of the air (hot air) heated by the heating device from flowing toward the ink ribbon cartridges 3 (the heads 3*a* and the ink ribbons 3*d*) as an image forming unit, thereby preventing the ink ribbons 3*d* from being melted unnecessarily. This makes it possible to restrain or prevent reduction of an image formation quality. With the configuration set forth just above, it is possible to deter the hot air from staying in a specific area (e.g., around the heating device). This makes it possible to prevent occurrence of various kinds of trouble (reduction of an image formation quality or occurrence of an erroneous operation of the respective control unit) which may otherwise be caused by the stagnant hot air.

In the embodiment described above, the Peltier element is used as the cooling device for cooling the images formed on the medium M. However, the present disclosure is not limited thereto. It may be possible to use other kinds of cooling devices.

In the embodiment described above, a single cooling device 10A is employed as the coloring conversion unit. Alternatively, it may be possible to employ a plurality of cooling devices.

In the embodiment described above, the cooling device 10A is fixed to the portion protruding frontwards from the lower end of the rear wall portion 32B of the guide unit 32. However, the present disclosure is not limited thereto. It may be possible to fix the cooling device 10A in other attachment positions. For example, the cooling device 10A may be fixed to the upper surface of the protruding portion of the rear wall portion 32B or the inner surface of the rear wall portion 32B. In other words, the cooling device 10A may be fixed to the inner portion of the guide unit 32.

The programs executed in the printer 1 are offered in a state that the programs are preliminarily incorporated in the storage unit such as the ROM 20*b*. Alternatively, the programs may be offered by recording the programs in a computer-readable recording medium in the form of installable or executable files. In addition, the programs may be offered or disseminated via a network such as the Internet.

In the embodiment described above, the hardware configuration and software configuration of the printer 1, the hardware configuration and outward configuration of the blower unit 31, the shape of the guide unit 32 and the hardware configuration and outward configuration of the cooling device 10A are presented merely by way of example. The present disclosure is not limited thereto.

Next, a description will be made of a second embodiment. The same elements in the figures used to describe the first embodiment will be designated by like reference symbols and will not be described in detail.

The printer 1A of the second embodiment (see FIG. 12) differs from the printer 1 of the first embodiment in that an electricity-removing unit 50 for removing static electricity is attached to the deterring unit 30. The configurations (the hardware configuration and the software configuration) of the printer 1A of the present embodiment other than the electricity-removing unit 50 remain the same as those of the printer 1 of the first embodiment.

Figure 12:
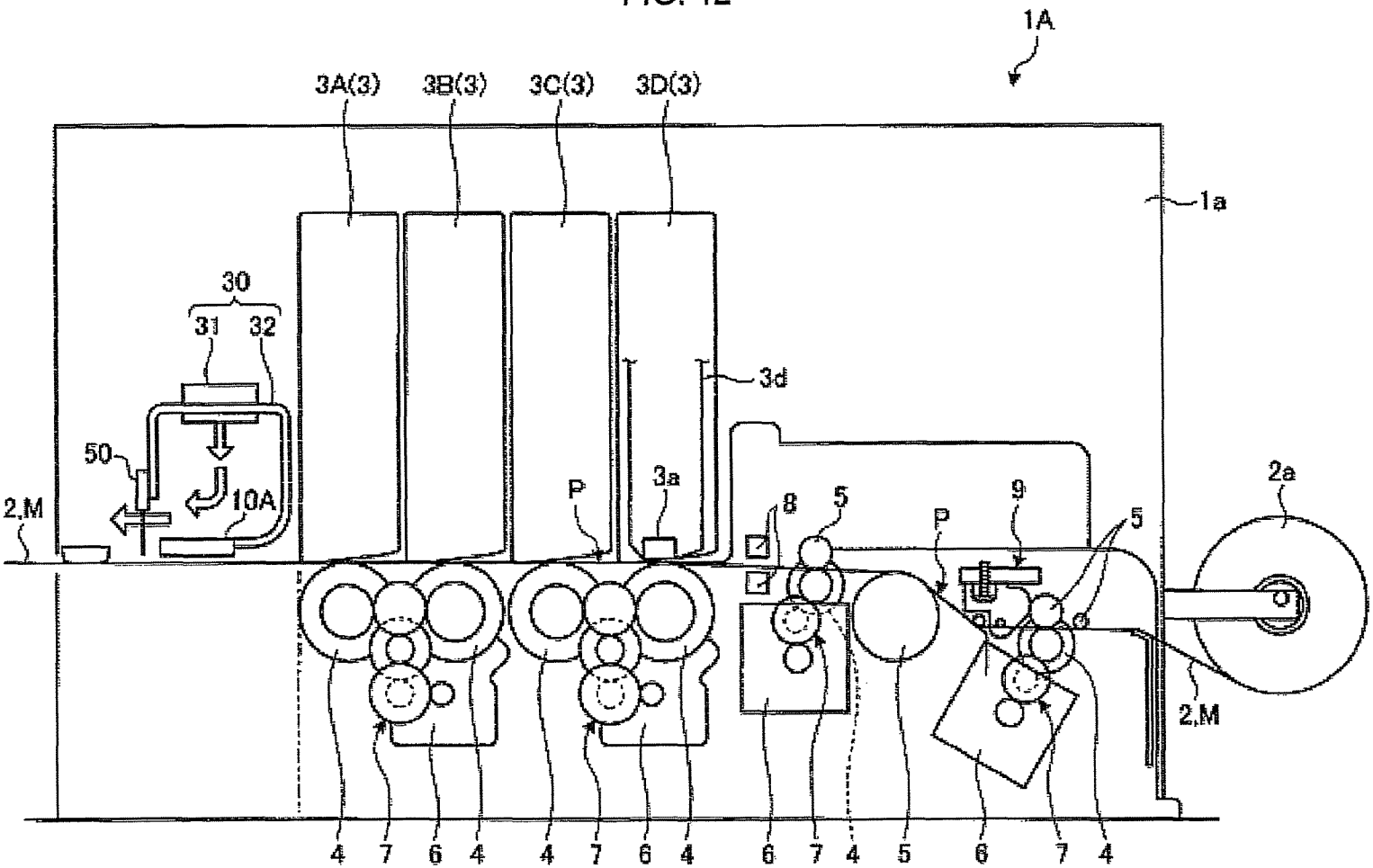
FIG. 12 is a side view showing a schematic configuration of a printer according to a second embodiment.
Figure 13:
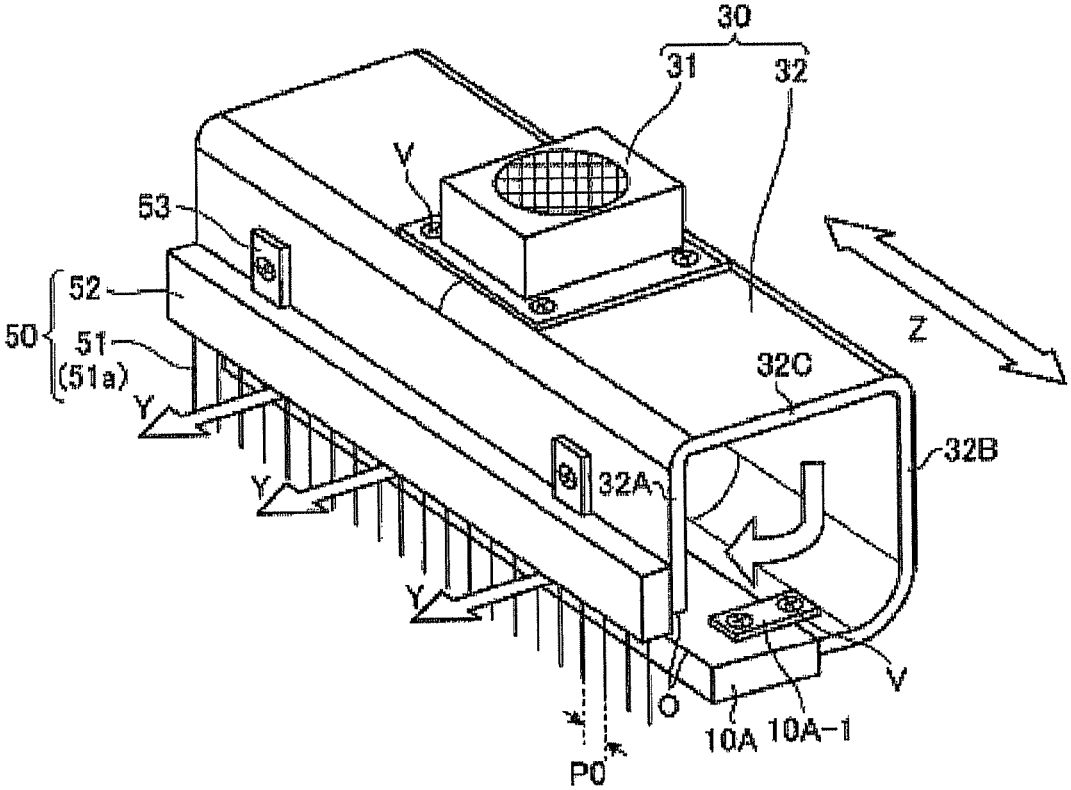
FIG. 13 is an assembled perspective view showing a deterring unit and an electricity-removing unit in an assembled state.
Figure 14:
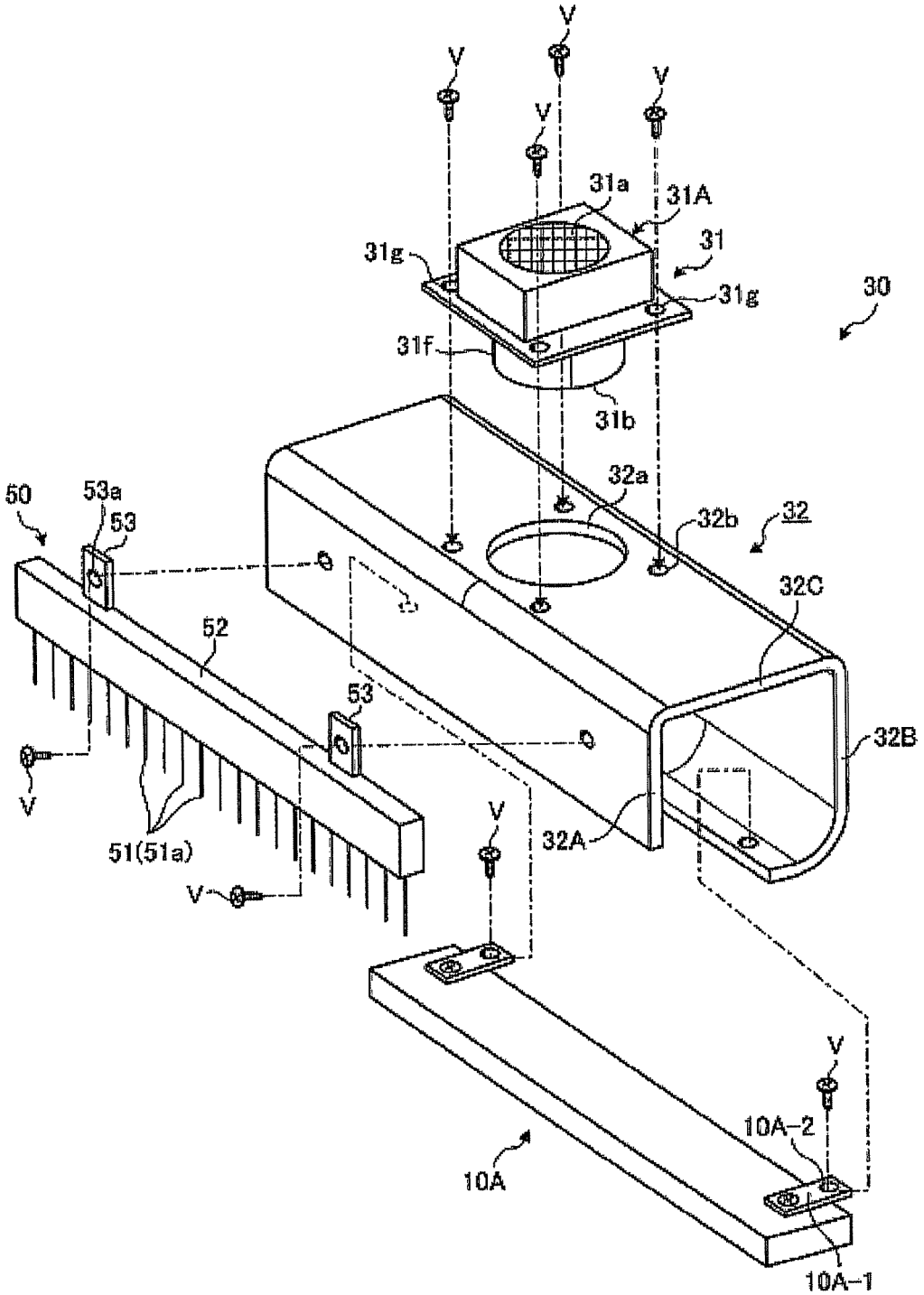
FIG. 14 is an exploded perspective view showing the deterring unit and the electricity-removing unit in an exploded state.
Figure 15:
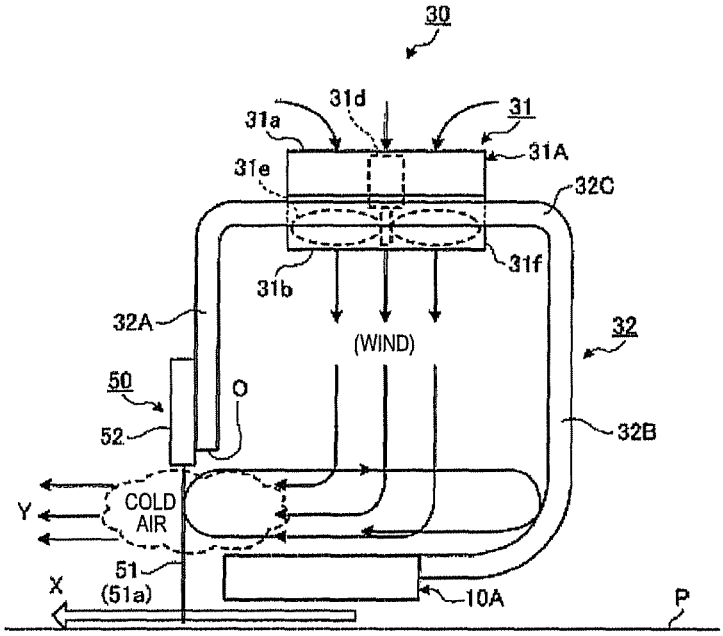
FIG. 15 is a side view of the deterring unit and the electricity-removing unit shown in FIG. 13.

FIG. 12 is a side view showing a schematic configuration of the printer 1A according to the second embodiment, which is configured by adding the electricity-removing unit 50 to the printer 1 of the first embodiment shown in FIG. 1. FIGS. 13 through 15 are views for explaining the configurations of the deterring unit 30 and the electricity-removing unit 50. FIG. 13 is an assembled perspective view showing the deterring unit 30 and the electricity-removing unit 50 in an assembled state. FIG. 14 is an exploded perspective view showing the deterring unit 30 and the electricity-removing unit 50 in an exploded state. FIG. 15 is a side view of the deterring unit 30 and the electricity-removing unit 50 shown in FIG. 13.

As shown in FIGS. 13 through 15, just like the deterring unit 30 described with respect to the first embodiment, the deterring unit 30 includes a blower unit (or a fan motor) 31 for blowing the air cooled by the cooling device 10A and a guide unit 32 for guiding the air blown by the blower unit 31 so as not to reach the ink ribbon cartridges 3. The configuration of the deterring unit 30 is substantially the same as the configuration of the deterring unit 30 of the first embodiment and therefore will not be described herein.

The electricity-removing unit 50 is fixed to the guide unit 32 by connector members 53 and screws V threadedly coupled to screw holes 53*a* of the connector members 53.

The electricity-removing unit 50 is an electricity-removing brush (static-electricity-removing brush) for air-discharging and removing static electricity frictionally generated when the air blown by the blower unit 31 is guided within the guide unit 32 and static electricity charged in the medium M.

More specifically, the electricity-removing unit 50 of the present embodiment includes a plurality of thin wires 51*a* composed of electrically conductive fibers capable of corona-discharging static electricity and a parallelepiped support body 52 for supporting the thin wires 51*a*. The support body 52 has a length substantially equal to the length in the width direction Z of the guide unit 32.

In the electricity-removing unit 50 of the present embodiment, wire bundles 51 each having a predetermined number of (e.g., ten) thin wires 51*a* that are arranged along the substantially full length in the width direction Z of the support body 52 at a specified pitch P0. Further, the specified pitch P0 is provided not to deter the flow of the air blown by the blower unit 31.

The electricity-removing unit 50 is arranged in the outlet O of the guide unit 32. The electricity-removing unit 50 causes a part of the cooled air to flow back into the guide unit 32 and temporarily stay within the guide unit 32 and causes a part of the cooled air (including the air flowing back into the guide unit 32) to be discharged from the outlet O to the outside of the guide unit 32. In other words, the electricity-removing unit 50 serves to solve a problem that the cooled air existing around the cooling device 10A is unnecessarily removed by the wind of the blower unit 31, as a result of which the cooling effect of the cooling device 10A is reduced.

When the electricity-removing unit 50 is attached to the body unit 1*a* of the printer 1A in a usable state, the wire bundles 51 (the thin wires 51*a*) make contact with the conveyance path P (particularly, the medium M conveyed along the conveyance path P).

Thus, the electricity-removing unit 50 of the present embodiment removes the static electricity generated in the deterring unit 30 and the static electricity charged in the medium M conveyed along the conveyance path P (particularly, the medium M on which the images are formed).

According to the present embodiment, the electricity-removing unit 50 can remove the static electricity generated by the action of the deterring unit 30, which helps restrain or prevent the medium M and various kinds of electronic parts such as the cooling device controller 20*p* and the blower unit controller 31*c* from being charged with static electricity. This makes it possible to prevent the electronic parts from being erroneously operated or broken and to prevent dust from adhering to the medium M on which the images are formed.

According to the present embodiment, the thin wires 51*a* of the electricity-removing unit 50 can restrain the cooled air existing around the cooling device 10A from being unnecessarily removed by the wind of the blower unit 31. This makes it possible to prevent reduction of the cooling effect of the cooling device 10A.

While one illustrative embodiment has been described above, the present disclosure is not limited to this embodiment.

For example, as set forth with respect to the first embodiment, it may be possible to provide a print system in which the respective components (particularly, the image forming unit and the coloring conversion unit) are arranged independently of each other.

Figure 16:
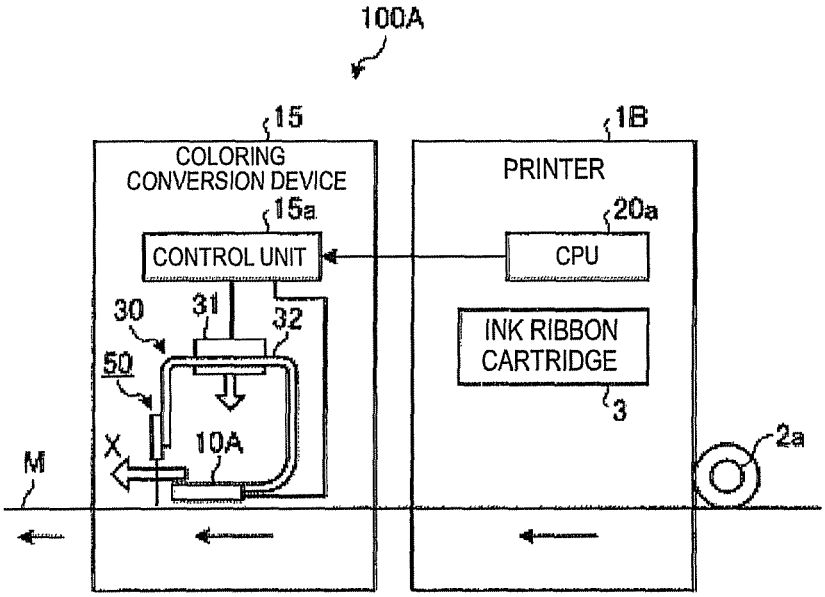
FIG. 16 is a side view showing a schematic configuration of a print system.

More specifically, as shown in FIG. 16, it may be possible to provide a print system 100A including a printer 1B and a coloring conversion device 15. The printer 1B includes a CPU 20*a*, a plurality of ink ribbon cartridges 3 as an image forming unit capable of forming, on a medium M, images of a temperature-sensitive ink whose color is changed depending on a temperature, and a conveying unit which is composed of conveying rollers 4, auxiliary rollers 5, a motor 6 and a rotation-transmitting mechanism (or a speed-reducing mechanism) 7. The coloring conversion device 15 includes a control unit 15*a* for receiving a control signal issued from the CPU 20*a*, a coloring conversion unit (e.g., a cooling device 10A) for heating or cooling the images formed by the image forming unit of the printer 1B and converting the coloring states of the images under the control of the control unit 15*a*, a deterring unit 30 for deterring at least a part of the air heated or cooled by the coloring conversion unit from flowing toward the image forming unit or staying in a specific area and an electricity-removing unit 50 for removing the static electricity generated by the action of the deterring unit 30.

In the electricity-removing unit 50 of the embodiment described above, the wire bundles 51 each having a predetermined number of (e.g., ten) thin wires 51*a* are arranged along the substantially full length in the width direction Z of the support body 52 at a specified pitch P0. Alternatively, it may be possible to use an electricity-removing unit 50 in which an individual thin wire 51*a* is arranged along the substantially full length in the width direction Z of the support body 52 at a specified pitch P0.

Figure 17:
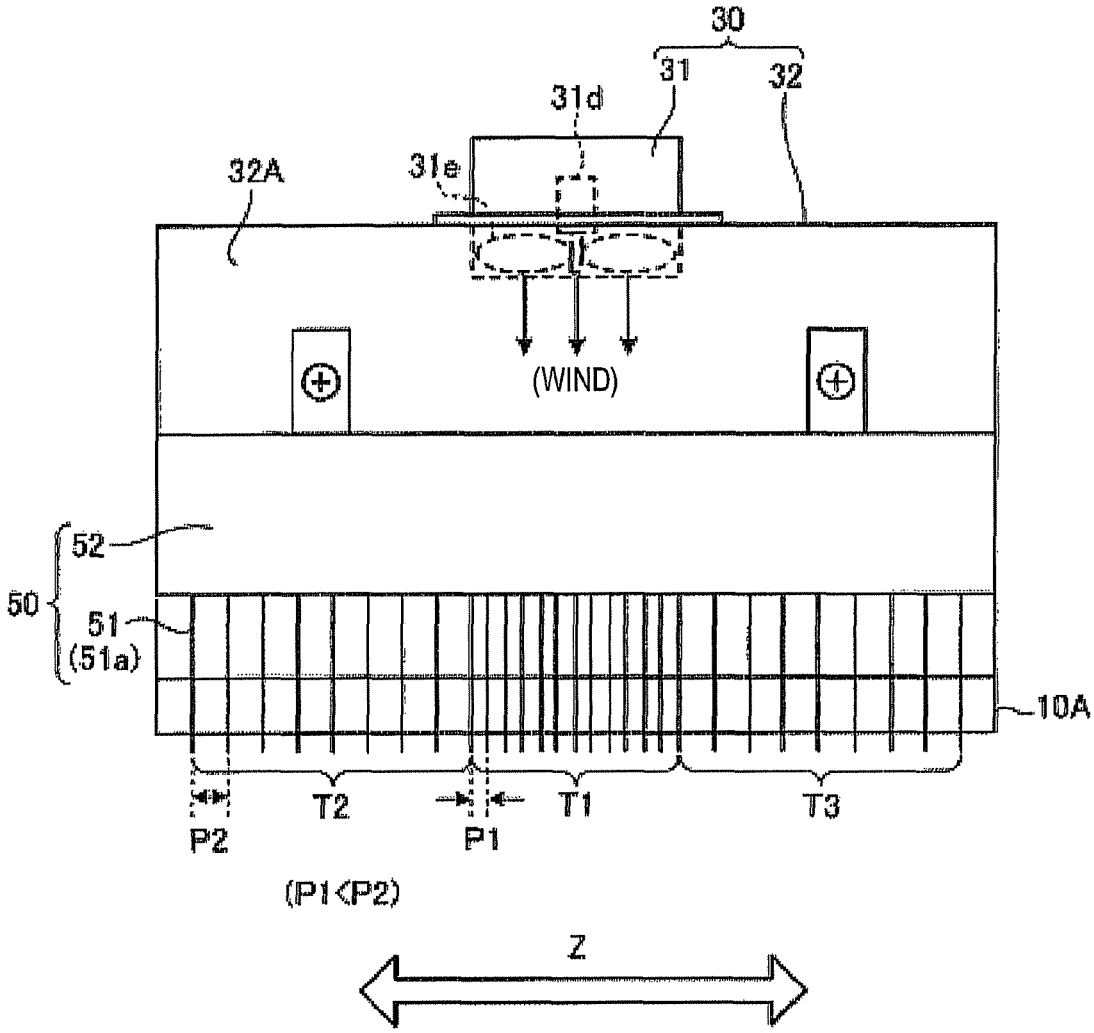
FIG. 17 is a front view of the deterring unit, the cooling device and the electricity-removing unit shown in an assembled state in FIG. 13.

In the electricity-removing unit 50 of the embodiment described above, the wire bundles 51 each having a predetermined number of thin wires 51*a* are fixed to the support body 52 at a specified pitch P0. However, the present disclosure is not limited thereto. The wire bundles 51 may be fixed at other pitches. For example, as shown in FIG. 17, the wire bundles 51 may be fixed to support body 52 at different pitches in a plurality of transverse sections divided along the width direction Z of the electricity-removing unit 50. FIG. 17 is a front view of the deterring unit 30, the cooling device 10A and the electricity-removing unit 50 shown in an assembled state in FIG. 13.

More specifically, the flow of the air blown by the fan 31*e* of the blower unit 31 is strong in, e.g., a transverse section T1 corresponding to the attachment position of the blower unit 31 of the deterring unit 30. With a view to restrain the air cooled by the cooling device 10A from being unnecessarily removed by the fan 31*e* of the blower unit 31, the wire bundles 51 are arranged at a relatively small first pitch P1 in the transverse section T1. On the other hand, the flow of the air is weak in transverse sections T2 and T3 that do not correspond to the attachment position of the blower unit 31 of the deterring unit 30. Thus, the wire bundles 51 are arranged at a relatively large second pitch P2 in the transverse sections T2 and T3. The first pitch P1 is set smaller than the second pitch P2.

In the embodiment described above, the self-discharged electricity-removing brush capable of discharging static electricity in the air is used as the electricity-removing unit 50. However, the present disclosure is not limited thereto. Other types of electricity-removing brushes may be used. For example, it may be possible to use an electricity-removing brush of the type in which the static electricity charged in the thin wires 51*a* is discharged from the electrically conductive support body 52 to the outside of the printer 1A via an earth wire of the body unit 1*a* of the printer 1A.

In the embodiment described above, the electricity-removing brush (static-electricity-removing brush) is employed as the electricity-removing unit 50 for removing static electricity. However, the present disclosure is not limited thereto. Other types of electricity-removing members may be employed. For example, it may be possible to employ an electricity-removing sheet for discharging static electricity in the air. The electricity-removing sheet is formed by combining ultrafine fibers with an electrically conductive polymer matrix so that the tip ends of the ultrafine fibers can serve as conductor needles.

Next, a description will be made of a third embodiment. The same elements used in the figures to describe the first embodiment will be designated by like reference symbols and will not be described in detail.

The printer 1C of the third embodiment (see FIG. 18) greatly differs from the printer 1 of the first embodiment in that the printer 1C includes a visual recognition enabling unit. In the third embodiment, the unit removably mounted with a plurality of (four, in the present embodiment) ink ribbon cartridges 3 (3A through 3D) will be called a print block 300. In the third embodiment, the unit for conveying the backing paper (the medium M) through the use of the conveying rollers 4, the auxiliary rollers 5, the motor 6 and the rotation-transmitting mechanism 7 will be called a conveying unit 50A.

In the third embodiment, the cooling device 10A is changed to a cooling mechanism 10. The cooling mechanism 10 is arranged along and below the conveyance path P.

In the present embodiment, the cooling mechanism 10 is configured to spout, e.g., a gas, and reduce the temperature of the medium M, namely the temperature of temperature-sensitive ink images, using the adiabatic expansion or the latent heat of the gas. More specifically, the cooling mechanism 10 includes a mounting portion 10*a* for holding a gas cartridge 11 of a gas cylinder, a spouting portion 10*b*, a tube 10*c*, a valve 10*d* and a cooling fin 10*e*.

The gas cartridge 11 is removably mounted to the mounting portion 10*a*. The mounting portion 10*a* serves as a connector for receiving a connector 11*a* of the gas cartridge 11. The mounting portion 10*a* may include a movable lever (not shown) used in removing the gas cartridge 11 and a lock mechanism (not shown) for fixing the gas cartridge 11 in a mounting position.

The gas cartridge 11 may be made up of, e.g., a gas cylinder (gas bomb) filled with a liquefied gas. As the gas (coolant), it is possible to use, e.g., tetrafluoroethane.

Figure 18:
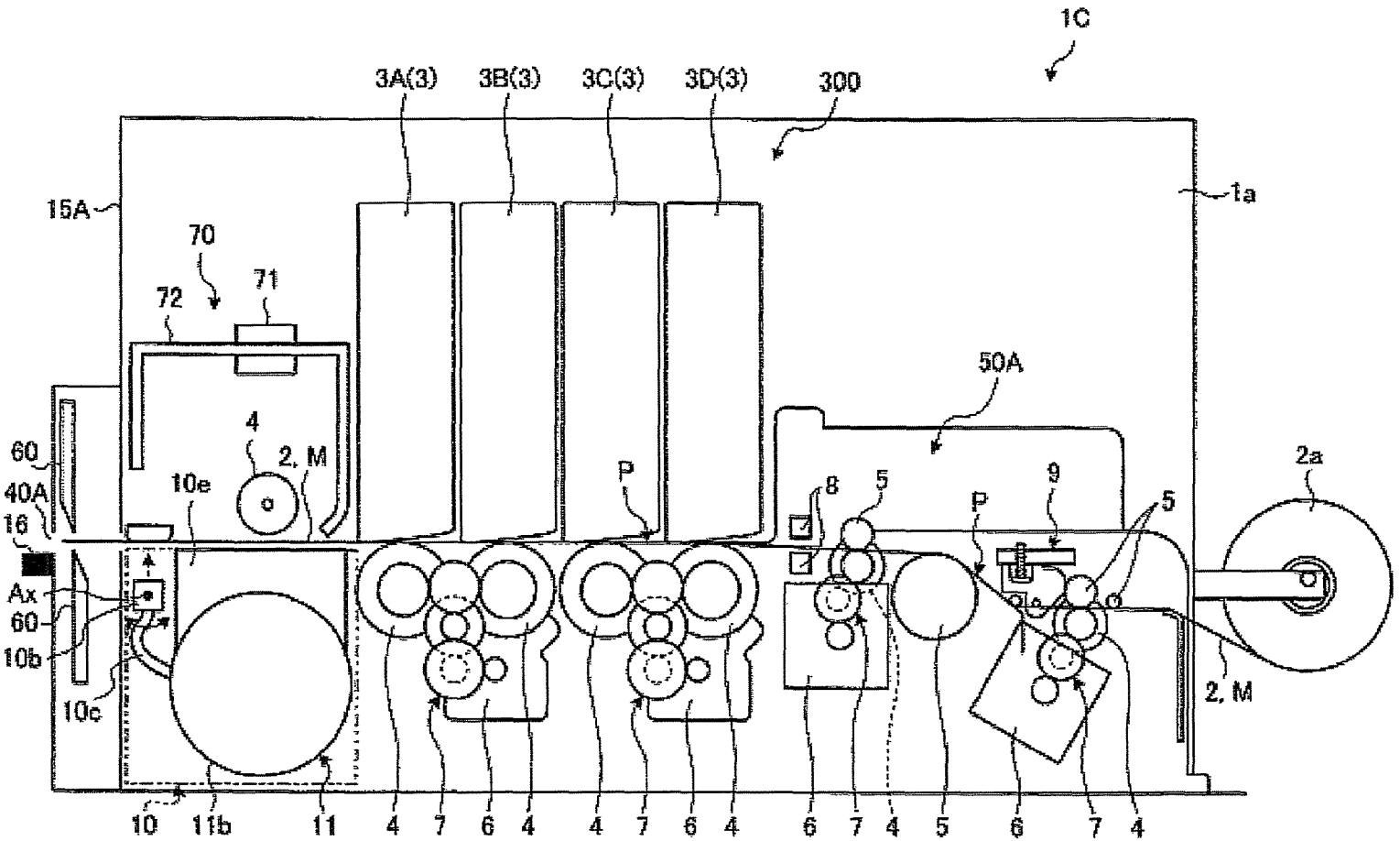
FIG. 18 is a side view showing a schematic configuration of a printer according to a third embodiment.
Figure 19:
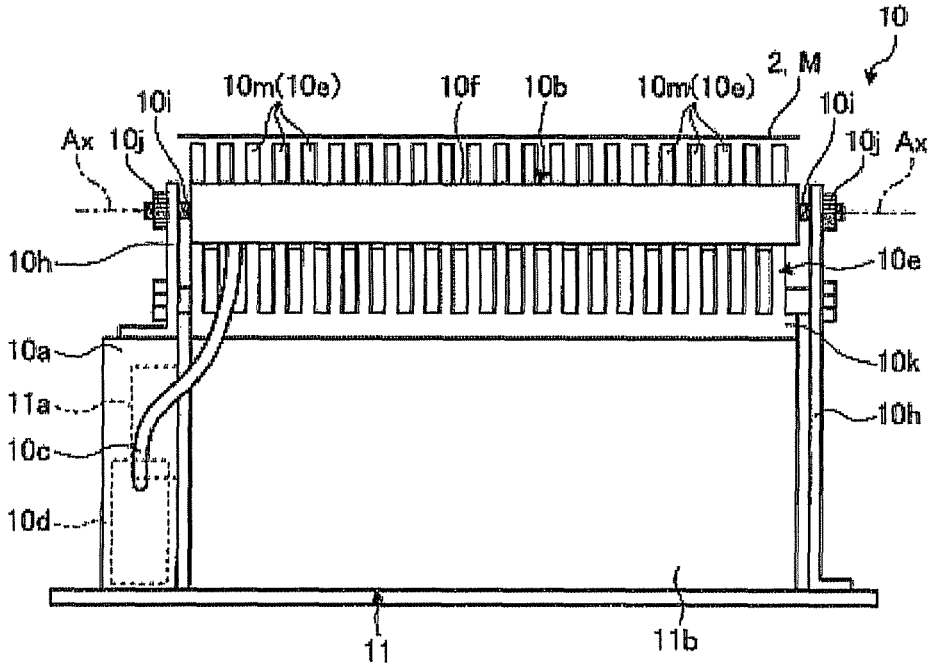
FIG. 19 is a front view showing a cooling mechanism of the printer shown in FIG. 18.
Figure 21:
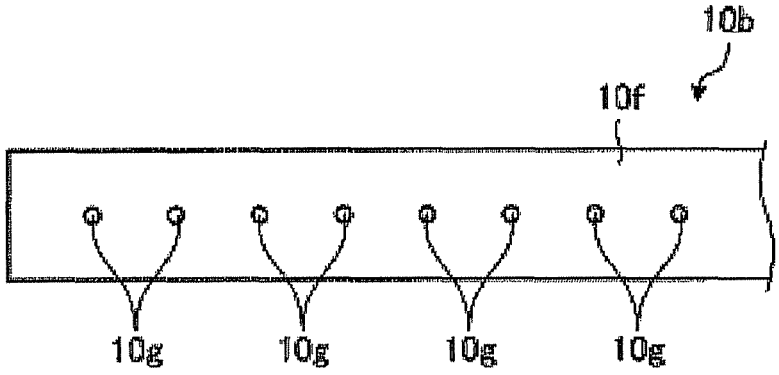
FIG. 21 is a plan view of a portion of the spouting portion of the cooling mechanism shown in FIG. 19, which is seen at the side of a backing paper.

As shown in FIGS. 18 and 19, the spouting portion 10*b* is arranged to extend in the width direction of the backing paper 2 along the rear surface of the backing paper 2. The spouting portion 10*b* is a gas pipe having a gas flow path formed therein. Referring to FIG. 21, the spouting portion 10*b* has an upper wall 10*f* and a plurality of nozzle holes 10*g* formed side by side in the upper wall 10*f* at a regular interval (pitch). The gas is spouted from the nozzle holes 10*g* toward the rear surface of the backing paper 2. The nozzle holes 10*g* may be arranged in plural rows.

Figure 20A:
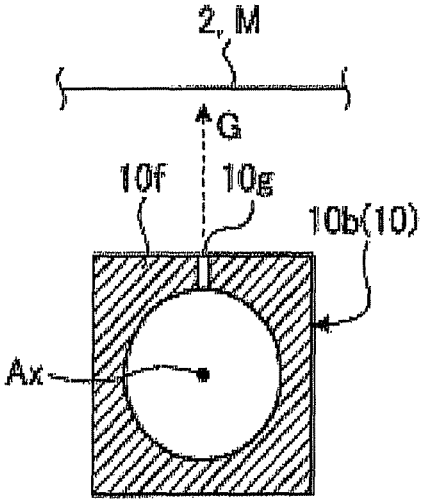
FIGS. 20A and 20B are section views showing a spouting portion included in the cooling mechanism shown in FIG. 19, FIG. 20A illustrating a state in which a gas is spouted at a right angle with respect to a medium and FIG. 20B illustrating a state in which the gas is obliquely spouted with respect to the medium.
Figure 20B:
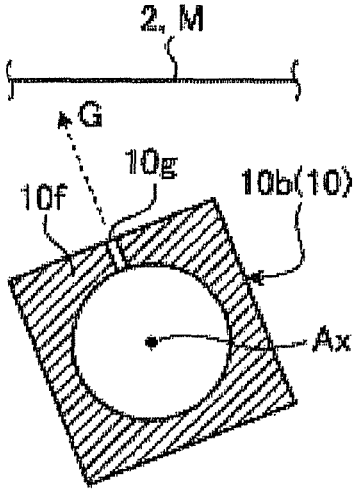

The spouting portion 10*b* is supported by brackets 10*h* to rotate about a rotation axis Ax extending in the width direction of the backing paper 2 and is capable of changing the spouting angle (spouting direction) of the gas G as illustrated in FIGS. 20A and 20B. More specifically, as shown in FIG. 19, the spouting portion 10*b* can be fixed at an arbitrary angle by arranging the spouting portion 10*b* at a specified spouting angle and then tightening nuts 10*j* to the male thread portions 10*i* of the spouting portion 10*b* inserted into the through-holes (not shown) of the brackets 10*h*. The cooling degree of the backing paper 2 cooled by the gas G can be variably set by variably setting the spouting angle. For instance, cooling is more heavily performed in the arrangement shown in FIG. 20A than in the arrangement shown in FIG. 20B. Thus, the temperature-sensitive ink images formed on the medium M have a lower temperature in the arrangement shown in FIG. 20A than in the arrangement shown in FIG. 20B. In the present embodiment, the spouting portion 10*b* includes a spouting condition adjusting mechanism as set forth above.

The tube 10*c* has pressure resistance and flexibility required for the tube 10*c* to serve as a gas conduit between the mounting portion 10*a* and the spouting portion 10*b* regardless of the change of the angle of the spouting portion 10*b*.

The valve 10*d* can switch the spouting of the gas from the spouting portion 10*b* and the blocking of the gas by opening or closing a gas flow path extending from the gas cartridge 11 to the spouting portion 10*b*. The valve 10*d* may be made up of, e.g., a solenoid valve which is opened in response to an electric signal supplied from a CPU 20*a* (see FIG. 24). The valve 10*d* can be attached to the mounting portion 10*a*. The spouting condition of the gas can be variably set by controlling the opening and closing of the valve 10*d* (e.g., the length of opening time, the number of times for opening and closing, and the period for opening and closing).

The cooling fin 10*e* includes a base portion 10*k* close to or adjoining to the outer circumferential surface 11*b* of the gas cartridge 11 and a plurality of plate-shaped portions 10*m* extending in the medium conveying direction and protruding from the base portion 10*k* toward positions near the rear surface of the backing paper 2. When the temperature of the gas cartridge 11 is reduced by spouting the gas, the cooling fin 10*e* can enhance the cooling performance for the medium M. The cooling mechanism 10 can be removably mounted to the body unit 1*a*.

The body unit 1*a* of the printer 1C includes a front panel 15A positioned above a paper discharge port 40A. The front panel 15A is formed of, e.g., a transparent resin. The reason for forming the front panel 15A with a transparent resin is to enable a user or other persons to confirm, at the outside of the printer 1C, the surface condition of the medium M existing near the cooling mechanism 10. In other words, the front panel 15A serves as a visual recognition enabling unit that enables a user or other persons to visually recognize, from outside of the printer 1C, the temperature-sensitive ink images formed on the medium M and subjected to coloring state conversion in the cooling mechanism 10.

The printer 1C of the present embodiment further includes a deterring unit 70 positioned between the cooling mechanism 10 and the print block 300. The deterring unit 70 is configured to deter at least a part of the air cooled by the cooling mechanism 10 from flowing toward the print block 300 and to deter the air cooled by the cooling mechanism 10 from staying in a specific area. The deterring unit 70 includes a blower unit 71 for blowing the air cooled by the cooling mechanism 10 and a guide unit 72 for guiding the air blown by the blower unit 71 so as not to reach the print block 300.

Figure 22:
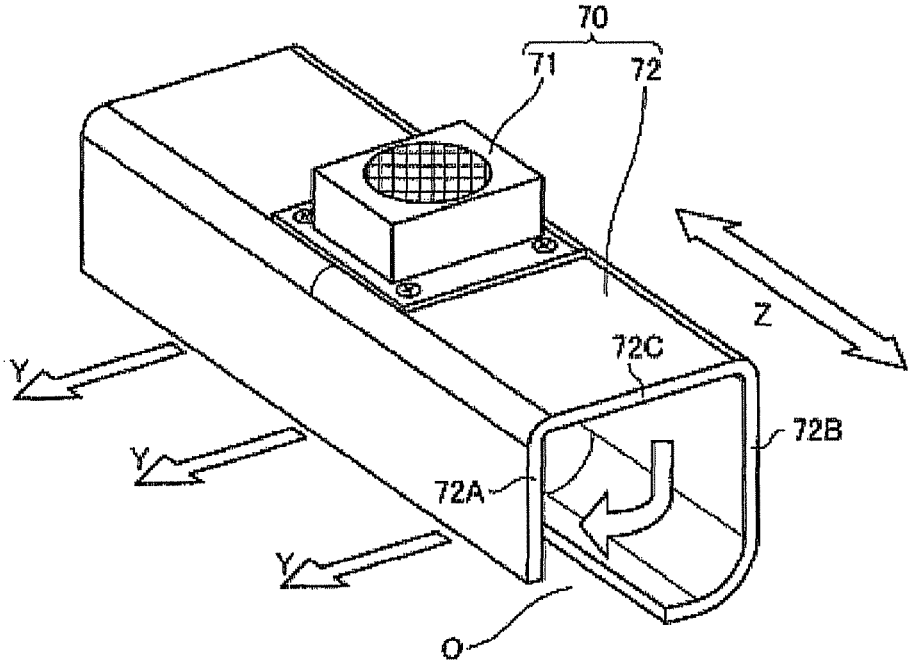
FIG. 22 is a perspective view schematically showing a deterring unit of the printer according to the third embodiment.

FIG. 22 is a perspective view schematically showing the deterring unit 70. As shown in FIG. 22, the guide unit 72 of the deterring unit 70 is a member shaped to form a portion of the conveyance path P and configured to guide the air blown by the blower unit 71 toward the downstream side along the conveying direction of the medium M. The guide unit 72 is made of, e.g., a transparent resin. Thus, the deterring unit 70 can maintain a visually recognizable state in which the temperature-sensitive ink images formed on the medium M and subjected to coloring state conversion in the cooling mechanism 10 can be visually recognized from the front panel 15A as a visual recognition enabling unit. The guide unit 72 includes a front wall portion 72A arranged near the downstream end of the conveyance path P in the medium conveying direction, a rear wall portion 72B arranged in opposing relationship with the front wall portion 72A and a top surface portion 72C configured to interconnect the front wall portion 72A and the rear wall portion 72B and arranged above the conveyance path P to extend parallel to the conveying plane of the conveyance path P. As can be seen in FIG. 22, unlike the deterring unit 30 of the first embodiment, the cooling device 10A is not fixed to the guide unit 72 in the deterring unit 70 of the third embodiment.

Figure 23:
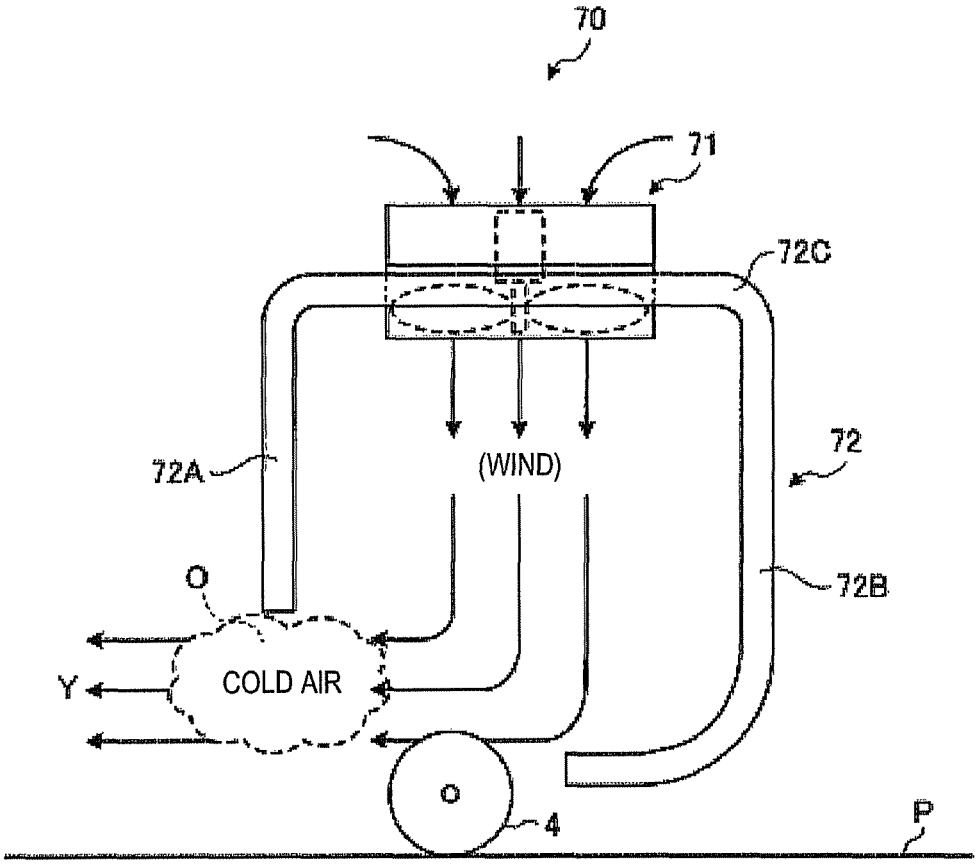
FIG. 23 is a side view of the deterring unit shown in FIG. 22.

FIG. 23 is a side view of the deterring unit 70. As shown in FIG. 23, the guide unit 72 of the deterring unit 70 is formed to have a generally trough-like side cross section. The length of the guide unit 72 in a width direction Z is substantially equal to the width of the conveyance path P. The guide unit 72 is arranged close to one surface (the upper surface) of the conveyance path P in alignment with the width of the conveyance path P.

The guide unit 72 having the shape set forth above guides the air (wind) blown by the blower unit 71 toward the cooling mechanism 10 arranged below the blower unit 71 and discharges the air (cold air) Y cooled by the cooling mechanism 10 from an outlet O defined below the front wall portion 72A.

The deterring unit 70 is provided with a conveying roller 4. The conveying roller 4 is arranged along and above the conveyance path P. The cooling mechanism 10 makes contact with the conveying roller 4 through the conveyance path P in such a manner as to move toward or away from the conveying roller 4. With this structure, a conveying force is applied to the backing paper 2 (the medium M) as the conveying roller 4 is rotationally driven. Thus, the backing paper 2 (the medium M) is conveyed toward the paper discharge port 40A.

A cutter mechanism 60 as a post-treatment device for cutting the backing paper 2 (the medium M) conveyed along the conveyance path P is provided near the paper discharge port 40A of the printer 1C at the downstream side of the cooling mechanism 10 in the medium conveying direction.

As shown in FIG. 18, the printer 1C further includes a dew-removing member 16 arranged in the body unit 1*a* near the paper discharge port 40A. The dew-removing member 16 is made of, e.g., a sponge material or a rubber spatula. By arranging the dew-removing member 16 in the body unit 1*a* near the paper discharge port 40A, a small amount of moisture generated in the backing paper 2 by dew condensation in the coloring process of the medium M can be removed when the backing paper 2 is discharged from the paper discharge port 40A. This makes it easy to handle a printed and cut label (to reduce difficulties in affixing the label).

Figure 24:
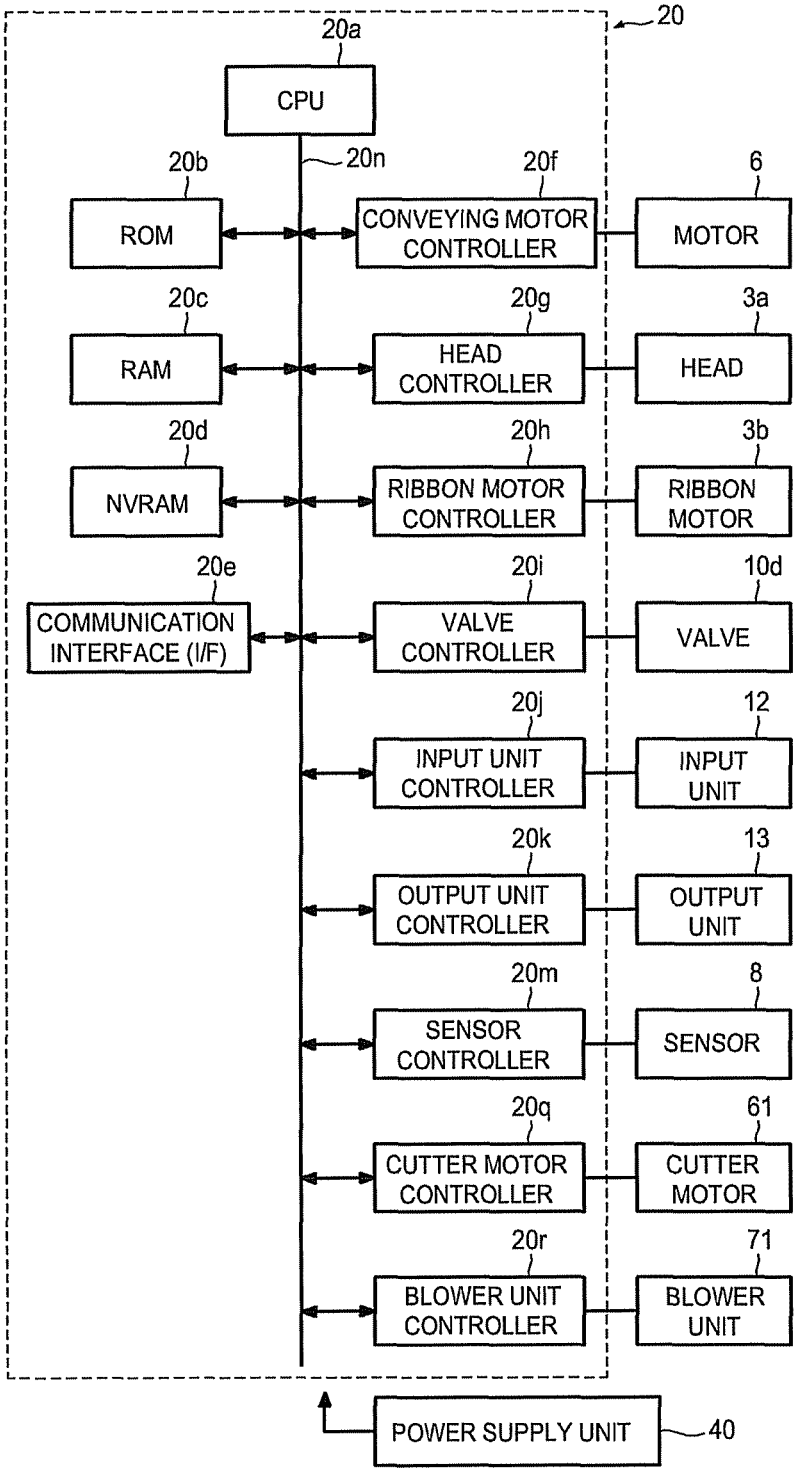
FIG. 24 is a block diagram showing a hardware configuration of a control system of the printer according to the third embodiment.

FIG. 24 is a block diagram showing a hardware configuration of the printer 1C of the third embodiment.

Referring to FIG. 24, the printer 1C of the third embodiment differs from the printer 1 of the first embodiment in that the control circuit 20 further includes a valve controller 20*i* and a cutter motor controller 20*q* and excludes the cooling device controller 20*p*. In this regard, the valve controller 20*i* controls the valve 10*d* (the solenoid of the valve 10*d*) of the cooling mechanism 10 pursuant to an instruction supplied from the CPU 20*a*.

The cutter motor controller 20*q* controls the operation of a cutter motor 61 as a drive power source of the cutter mechanism 60 in response to an instruction supplied from the CPU 20*a*.

The software configuration of the printer 1C of the third embodiment is substantially the same as the software configuration of the printer 1 of the first embodiment (see FIG. 7).

In the printer 1C of the third embodiment, the print control unit 21*a* also controls the cutter motor 61 by way of the cutter motor controller 20*q*.

The coloring conversion setting unit 21*b* performs various kinds of setting operations associated with the coloring conversion of the temperature-sensitive ink images printed on the medium M (the cooling performed by the cooling mechanism 10 in the present embodiment). More specifically, the coloring conversion setting unit 21*b* can cause the storage unit such as the NVRAM 20*d* to store a pitch (frequency) at which coloring conversion (cooling) is performed with respect to the medium M and a parameter for setting the opening or closing conditions of the valve 10*d* (e.g., the opening/closing timing, the opening/closing duration, the number of opening/closing times and the opening/closing period), which are inputted through the input unit 12.

The counter unit 21*c* and the determination unit 21*d* perform the same processing as set forth with respect to the first embodiment and therefore will not be described in detail.

The coloring conversion control unit 21*e* controls individual parts or units (the respective parts of the cooling mechanism 10 in the present embodiment) in order to perform coloring conversion (cooling in the present embodiment) with respect to the medium M (the temperature-sensitive ink images formed on the medium M) which is determined by the determination unit 21*d* to be subjected to coloring conversion. In the third embodiment, the coloring conversion control unit 21*e* performs the coloring conversion of the medium M by controlling the opening/closing condition of the valve 10*d* and consequently controlling the spouting state of the gas. The coloring conversion control unit 21*e* also corresponds to a spouting condition adjusting mechanism. In the present embodiment, pursuant to the setting of the pitch (frequency), the coloring conversion can be performed with respect to the temperature-sensitive ink images formed on all the media M or some of the media M.

The printer 1C configured as above can produce, e.g., a medium M as described in the first embodiment and illustrated in FIG. 8A or 8B.

Figure 25A:
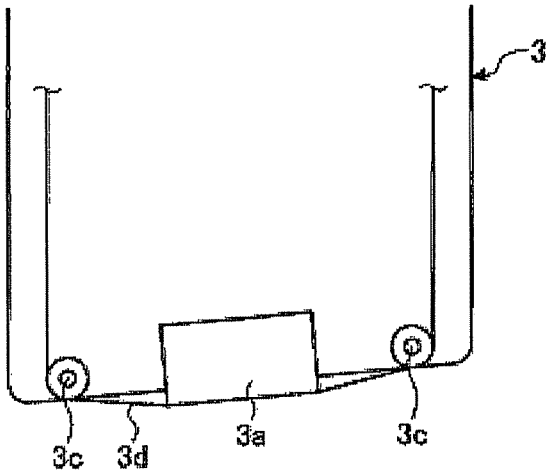
FIGS. 25A and 25B are side views schematically showing portions of ink ribbon cartridges included in the printer, FIG. 25A illustrating an ink ribbon cartridge having a long contact section over which an ink ribbon makes contact with a medium and FIG. 25B illustrating an ink ribbon cartridge having a short contact section over which an ink ribbon makes contact with a medium.
Figure 25B:
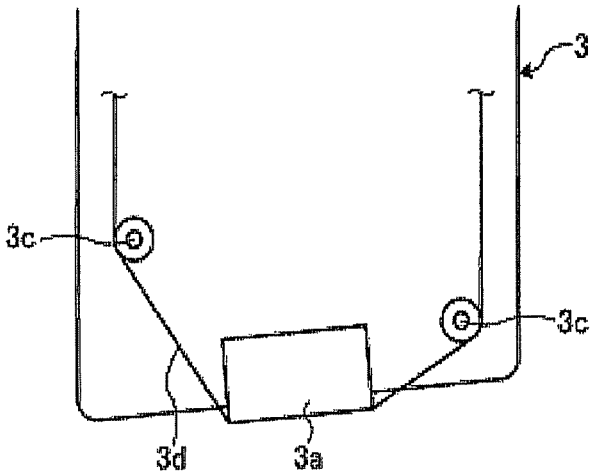
Figure 26:
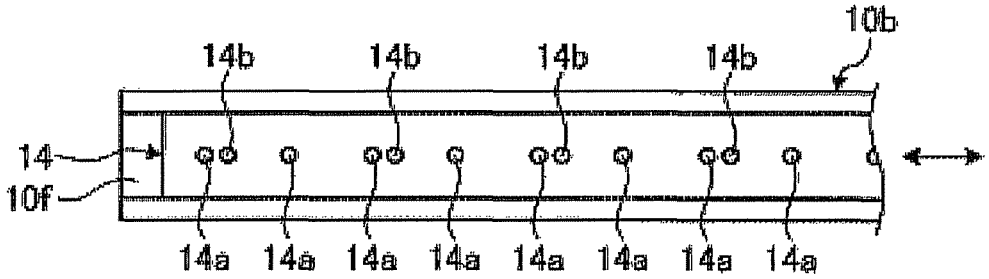
FIG. 26 is a plan view showing a movable plate included in a printer according to a modified example.

In the printer 1C of the present embodiment, as shown in FIGS. 25A and 25B, it is possible to use ink ribbon cartridges 3 that differ from each other in the positions of the ribbon rollers 3*c* with respect to the head 3*a*. In the configuration shown in FIG. 25A, the ink ribbon 3*d* and the medium M make contact with each other for a long period of time. In the configuration shown in FIG. 25B, the ink ribbon 3*d* and the medium M make contact with each other for a short period of time. One of these configurations can be selected depending on the properties of the temperature-sensitive ink or the typical ink. In the present embodiment, the ink ribbon cartridge 3 corresponds to an ink ribbon holding unit. The ribbon motor 3*b* and the ribbon rollers 3*c* make up a ribbon conveying unit.

In the printer 1C of the present embodiment described above, the head 3*a* of the ink ribbon cartridge 3 as an image forming unit forms temperature-sensitive ink images on the medium M and the cooling mechanism 10 as a coloring conversion mechanism converts the coloring of the images. According to the present embodiment, it is therefore possible to impart desired coloring states to the temperature-sensitive ink images formed on the medium M outputted from the printer 1C. It is also easy to confirm whether desired temperature-sensitive ink images are successfully formed on the medium M.

In the present embodiment, the cooling mechanism 10 as a coloring conversion unit reduces the temperature of the images by spouting a gas. This makes it possible to obtain the cooling mechanism 10 with a relatively simple configuration.

In the present embodiment, the printer 1C includes, as the spouting condition adjusting mechanism for adjusting the spouting condition of the gas, a mechanism for adjusting the posture of the spouting portion 10 (e.g., the spouting direction of the gas G spouted from the nozzle holes 10*g*) and a mechanism for variably setting the gas spouting timing or the gas spouting time period (e.g., the opening/closing period of the valve 10*d*). This makes it possible to suitably adjust the condition of the cooling performed by the gas.

As the spouting condition adjusting mechanism, it is possible to employ, e.g., a movable plate 14 for changing the number of effective nozzle holes 10*g* as shown in FIG. 16. The movable plate 14 is supported on the upper wall 10*f* of the spouting portion 10*b* to allow the movable plate 14 to slide along the upper wall 10*f*. The movable plate 14 has through-holes 14*a* overlapping with all the nozzle holes 10*g* when the movable plate 14 is in one position and through-holes 14*b* overlapping with some of the nozzle holes 10*g* when the movable plate 14 is in another position. By sliding the movable plate 14, it is possible to switch a state in which the gas is spouted from all the nozzle holes 10*g* through the through-holes 14*a* and a state in which the gas is spouted from some of the nozzle holes 10*g* through the through-holes 14*b*. This makes it possible to variably set the amount of the spouting gas, thereby variably setting the cooling degree of the temperature-sensitive ink images.

In the present embodiment, the printer 1C includes the heads 3*a* of the ink ribbon cartridges 3 as a plurality of image forming units for forming images of different temperature-sensitive inks on the medium M. Accordingly, a plurality of ink images differing in the temperature-sensitive property can be formed on the medium M, which makes it possible to perform temperature management in multiple stages.

In the present embodiment, the cooling mechanism 10 cools the temperature-sensitive ink image extracted (selected or designated) and converts the coloring state thereof. This configuration can reduce energy consumption as compared to when all the temperature-sensitive ink images are cooled.

Figure 27:
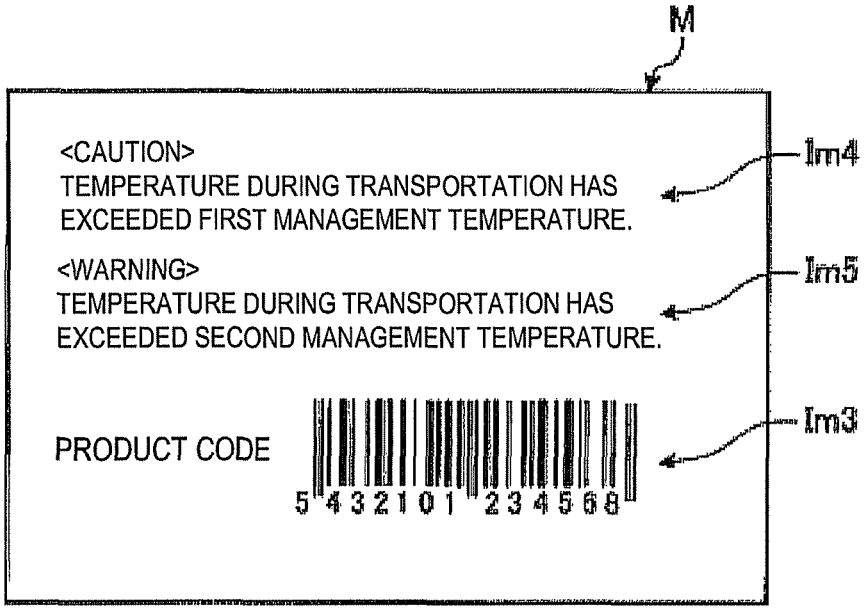
FIG. 27 is a view showing one example of a product label as a medium obtained in the printer according to the modified example.

In the printer 1C, it is also possible to use a temperature-sensitive ink having a property opposite to the property of the temperature-sensitive ink stated above, namely a temperature-sensitive ink having such a property that the temperature-sensitive ink is visualized when the temperature thereof exceeds a management temperature. For example, as shown in FIG. 27, if the ink temperature is higher than the threshold temperature, a message of "caution" or "warning" indicating that the temperature of temperature-sensitive ink image Im4 or Im5 has exceeded the management temperature appears on the medium M as a product label. In this example, images Im4 and Im5 of temperature-sensitive inks differing in the threshold temperature are formed on the medium M, which makes it possible to manage a product at different temperatures. In the printer corresponding to the example shown in FIG. 27, a heating mechanism instead of the cooling mechanism 10 can be provided as the coloring conversion unit. In this example, the temperature-sensitive ink images Im4 and Im5 are visualized to issue a caution notice or a warning notice when a specified temperature condition is not satisfied.

According to the present embodiment, it is possible to solve a problem that, if the temperature-sensitive ink images formed on the medium M and subjected to coloring state conversion in the cooling mechanism 10 as a coloring conversion unit are erased due to a temperature rise or other causes before the medium M is cut by the cutter mechanism 60, the formation of desired temperature-sensitive ink images on the medium M cannot be confirmed after the medium M is cut by the cutter mechanism 60. The provision of the visual recognition enabling unit for enabling a user or other persons to visually recognize, from outside the printer 1C, the temperature-sensitive ink images formed on the medium M and subjected to coloring state conversion in the cooling mechanism 10 makes it possible to confirm the temperature-sensitive ink images. Accordingly, it is possible to provide a printer in which, when forming temperature-sensitive ink images on the medium M, trouble is hardly caused due to the color change of a temperature-sensitive ink.

When the deterring unit for deterring at least a part of the air cooled or heated by the coloring conversion unit from flowing toward the print block 300 is arranged between the visual recognition enabling unit and the medium M, the deterring unit is made of e.g., a transparent resin. This makes it possible to maintain a visually recognizable state in which the temperature-sensitive ink images formed on the medium M and subjected to coloring state conversion in the cooling mechanism 10 can be visually recognized from the visual recognition enabling unit.

Figure 28:
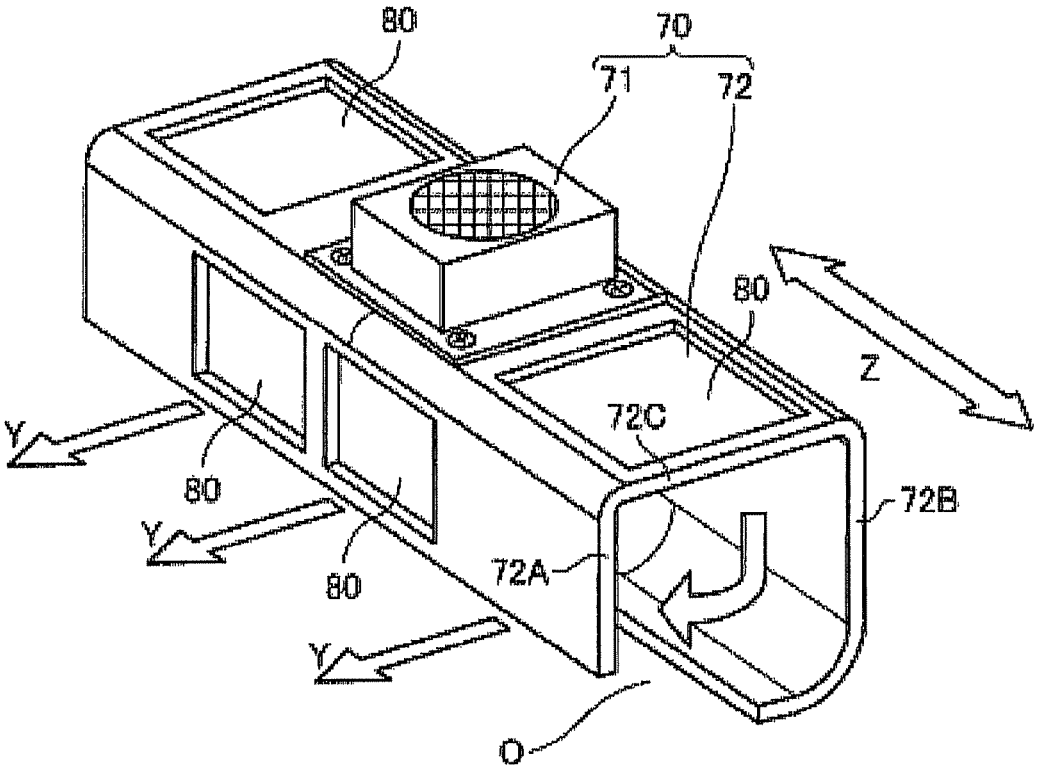
FIG. 28 is a perspective view schematically showing a deterring unit according to a modified example.

While the guide unit 72 of the deterring unit 70 is made of a transparent resin in the printer 1C of the present embodiment, the present disclosure is not limited thereto. As shown in FIG. 28, the guide unit 72 may be made of an opaque metal or resin and may have at least one opening 80 through which to visually recognize the surface condition of the medium M existing near the cooling mechanism 10.

While the cutter mechanism 60 for cutting the backing paper (or the medium M) conveyed along the conveyance path P is employed as a post-treatment device in the printer 1C of the present embodiment, the present disclosure is not limited thereto. It may be possible to employ various kinds of post-treatment devices such as a peeling mechanism for peeling the medium M from the backing paper 2 conveyed along the conveyance path P, a take-up mechanism for winding the backing paper (or the medium M) conveyed along the conveyance path P and a stacker mechanism.

In the printer 1C of the present embodiment, the print block 300, the cooling mechanism 10 and the cutter mechanism 60 are arranged within the body unit 1*a* in the named order from the upstream side to the downstream side of the medium conveying direction along the conveyance path P. However, the present disclosure is not limited thereto. The print block 300 and the cooling mechanism 10 may be arranged within the body unit 1*a* in the named order (or another order) and the cutter mechanism 60 as a post-treatment device may be installed independently.

Next, a description will be made on a modified example of the third embodiment. The same elements used in the figures of the third embodiment will be designated by like reference symbols and will not be described in detail.

Figure 29:
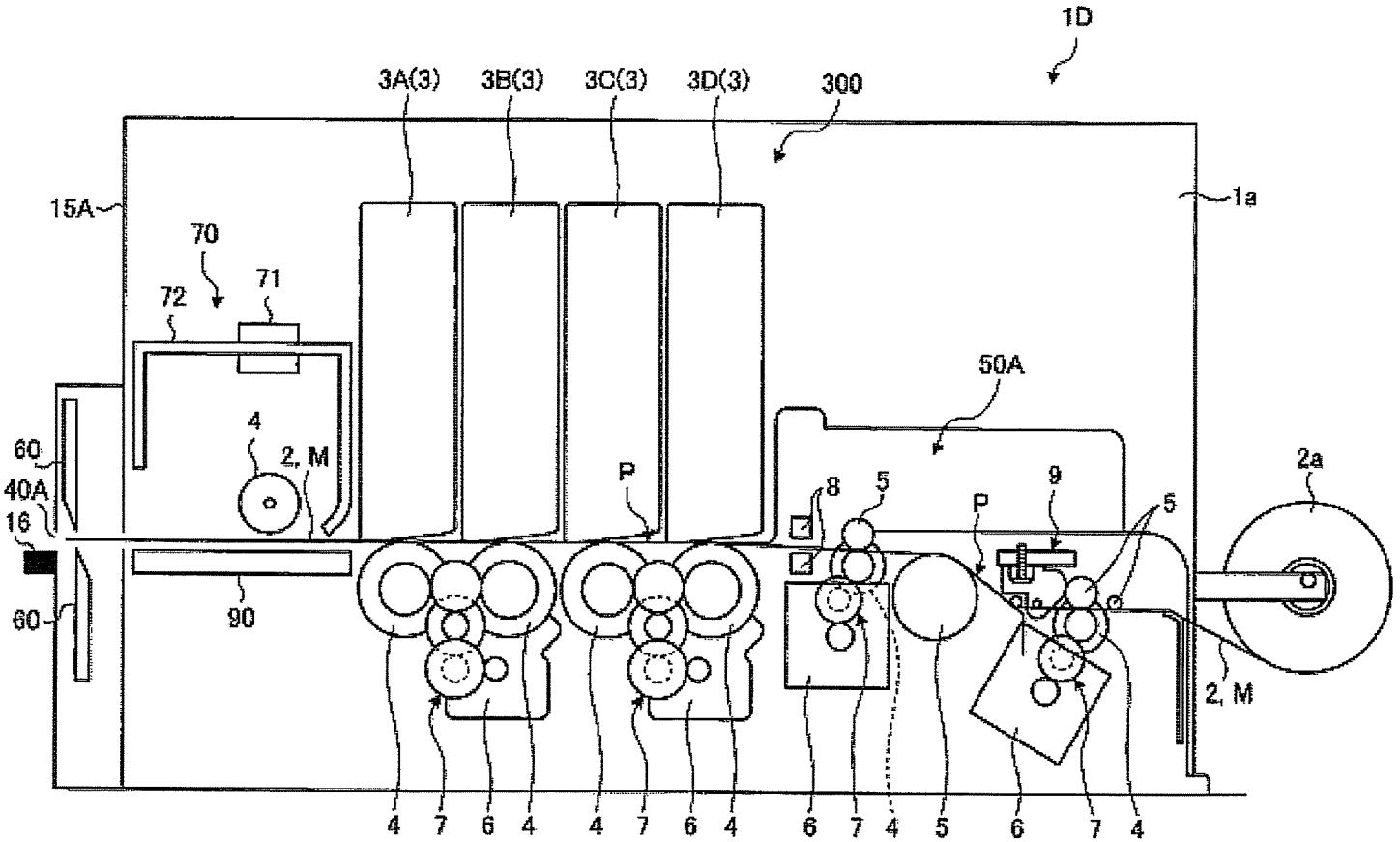
FIG. 29 is a side view showing a configuration of a printer according to a modified example of the third embodiment.

FIG. 29 is a side view showing a schematic configuration of a printer 1D as a modified example of the printer 1C of the third embodiment. As shown in FIG. 29, the printer 1D of the present embodiment includes a cooling element 90 as a coloring conversion unit in place of the cooling mechanism 10 employed in the printer 1C of the third embodiment. The cooling element 90 is arranged along and below the conveyance path P. Just like the cooling device 10A described in the first and second embodiments, the cooling element 90 is formed of, e.g., a Peltier element. The Peltier element is cooled by the air blown from the blower unit 71 of the deterring unit 70.

Figure 30:
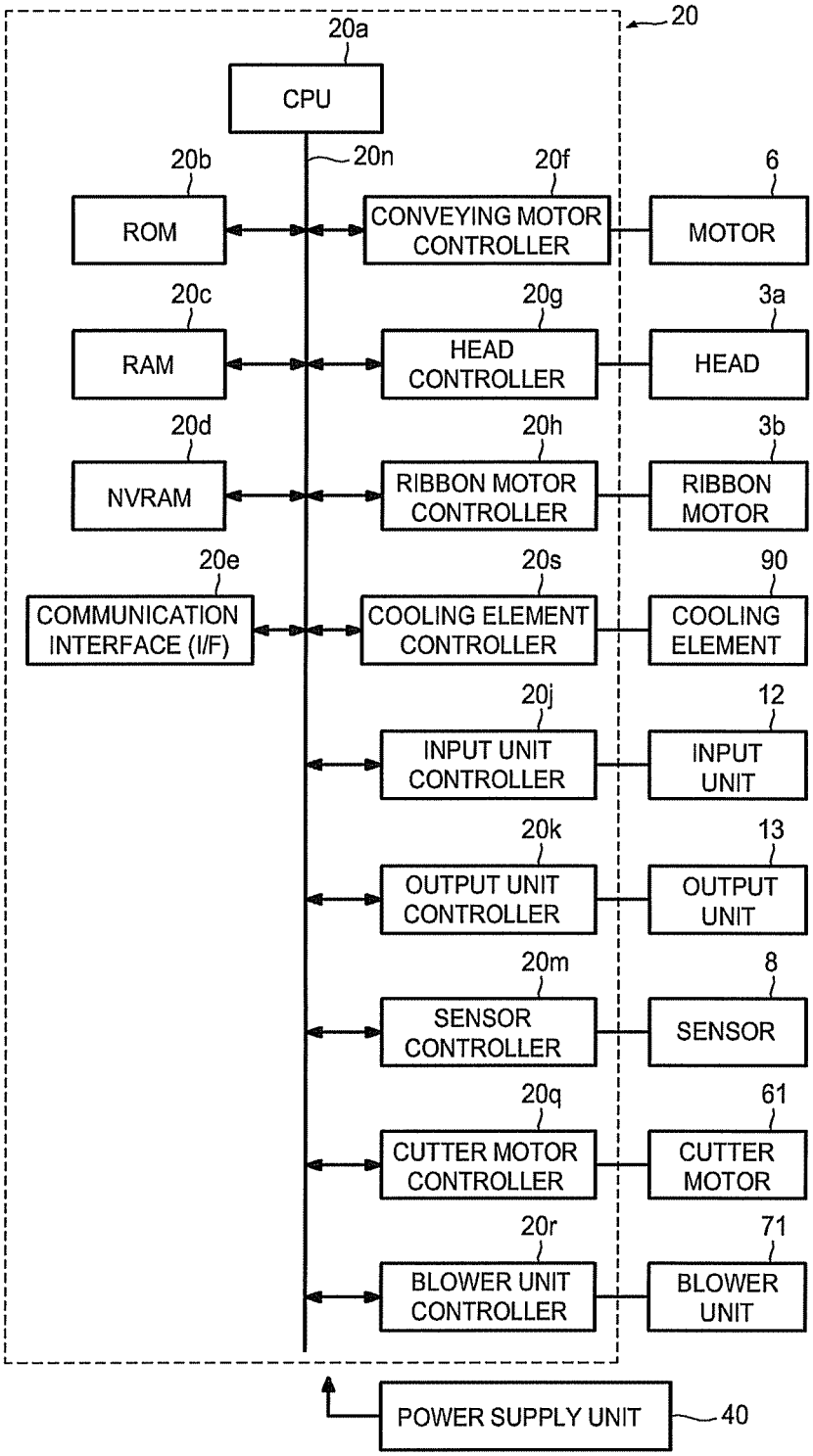
FIG. 30 is a block diagram showing a hardware configuration of a control system of the printer shown in FIG. 29.

Referring to FIG. 30, the cooling element 90 is controlled by a cooling element controller 20*s* pursuant to an instruction supplied from the CPU 20*a*.

According to the present modified example, the printer 1D is provided with the cooling element 90 in place of the cooling mechanism 10 employed in the printer 1C of the third embodiment. Therefore, as compared with the printer 1C of the third embodiment, the volume of the cooling device is reduced, which assists in reducing the size of the printer. Moreover, it becomes possible to reduce humidity change in the cooling process and to suppress occurrences of noises and vibrations.

Figure 31:
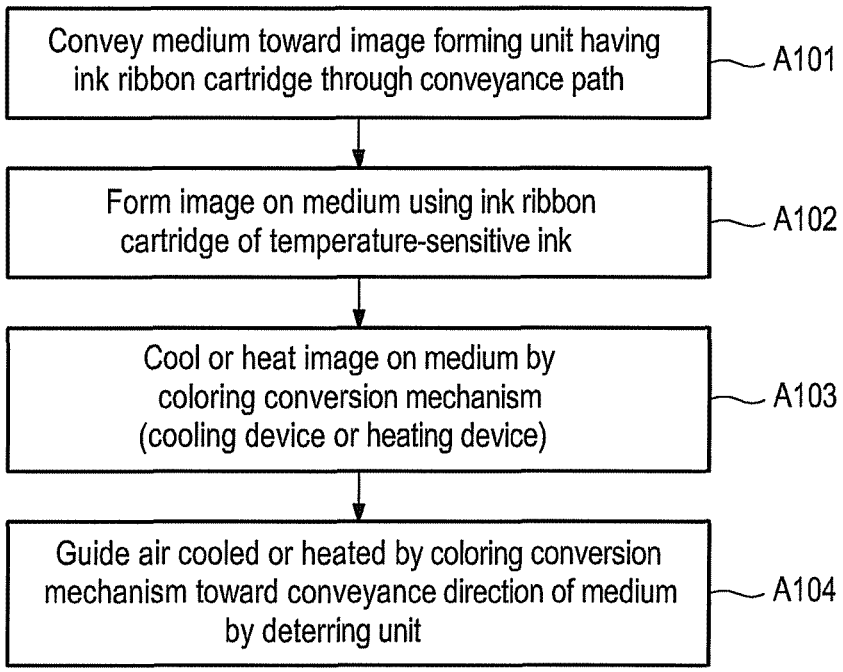
FIG. 31 is a flowchart illustrating a printing process according to one embodiment.

A printing method according to the printer of the above embodiments is shown in FIG. 31. First, the medium M is conveyed to the image forming unit through the conveyance path (Act A101). The medium M, which is for example the backing paper 2 made up of the roll 2*a* of FIG. 1, is drawn away from the roll 2*a* in cooperation with the conveying roller 4 and conveyed into the conveyance path. Once the medium M is conveyed to the image forming unit, an image is formed on the medium M by the ink ribbon cartridge of the temperature-sensitive ink (Act A102). The ink ribbon cartridge can be detachably provided in plural in the main body of the printer. As the ink ribbon cartridge, an ink ribbon cartridge of a non-temperature-sensitive ink whose color is not changed depending on a temperature, as well as an ink ribbon cartridge of a temperature-sensitive ink, can be provided. And then the medium M on which an image of a temperature-sensitive ink is formed is subjected to the treatment for converting the coloring state of the image by a coloring conversion unit (Act A103). The coloring conversion unit may be a cooling device or heating device and can be a device provided at an upstream side of the conveyance path as shown in FIG. 1 or a device provided at a downstream side of the conveyance path as shown in FIG. 18. With the coloring state conversion treatment by the coloring conversion unit, the image of the corresponding temperature-sensitive ink is visualized on the medium M and thus is made easier to see. Thus, the state in which the image is formed can be easily confirmed. After, the air cooled or heated by the coloring conversion unit is guided toward to the conveyance direction of the medium M by the deterring unit (Act A104). If the cooled or heated air flows toward the ink ribbon cartridge forming the image forming unit, the image forming quality of the image forming unit can be lowered. Thus, in order to consistently maintain the temperature environment of the image forming unit, the cooled or heated air is guided through the deterring unit toward an opposite side of the ink ribbon cartridge (the conveyance direction of the medium). For example, the deterring unit may be made up of a blower unit for discharging air, a guiding portion for guiding the blown air, etc. Meanwhile, in order to remove static electricity generated by friction of the air guided toward the conveying direction of the medium, an electricity-removing unit, which is for example made up of a static electricity-removing brush, etc., can be provided to remove the generated static electricity.

While certain preferred embodiments have been described above, the present disclosure is not limited thereto but may be modified in many different forms. For example, the printer may include three or more image forming units for forming images of different temperature-sensitive inks. The printer may include both the cooling mechanism and the heating mechanism as the coloring conversion unit. In this case, one of the cooling mechanism and the heating mechanism may be caused to act on the temperature-sensitive ink images to first bring the images into an easy-to-see (visible) state. Thereafter, the other may be caused to act on the temperature-sensitive ink images to bring the images into a hard-to-see (invisible) state (namely, to return the images to the original state). This enables a worker or other persons to confirm the temperature-sensitive ink images in the easy-to-see (visible) state. The number of cooling mechanisms and heating mechanisms may be changed to many other numbers.

The printer may include a spouting portion for spouting a cold gas or a hot gas as the cooling mechanism or the heating mechanism. A cold gas or a hot gas can be fed from the outside to the spouting portion through a connector and a pipe. In this configuration, it is possible to omit the gas cartridge, which makes it possible to reduce the size of the printer proportionate to the omission of the gas cartridge.

The printer may be configured from a printer of another type using ink (e.g., an inkjet printer). In the case of an inkjet printer, an ink head corresponds to the image forming unit.

The cutter mechanism (the post-treatment device) 60 and the dew-removing member 16 employed in the third embodiment may be applied to the first and second embodiments.

The specifications (type, structure, shape, size, arrangement, position, number, constituent or temperature-sensitive property) of the respective components (the print system, the printer, the medium, the ink ribbon cartridge, the image forming unit, the coloring conversion unit (the cooling mechanism, the heating mechanism, the spouting condition adjusting mechanism and the coloring conversion device), the image or the temperature-sensitive ink) may be appropriately modified and embodied.

According to the embodiments and the modified examples described above, it is possible to provide a printer and a print system in which, when forming temperature-sensitive ink images on a medium, trouble is hardly caused due to the color change of a temperature-sensitive ink.

As used in this application, entities for executing the actions can refer to a computer-related entity, either hardware, a combination of hardware and software, software, or software in execution. For example, an entity for executing an action can be, but is not limited to being, a process running on a processor, a processor, an object, an executable, a thread of execution, a program, and a computer. By way of illustration, both an application running on an apparatus and the apparatus can be an entity. One or more entities can reside within a process and/or thread of execution and an entity can be localized on one apparatus and/or distributed between two or more apparatuses.

The program for realizing the functions can be recorded in the apparatus, can be downloaded through a network to the apparatus, or can be installed in the apparatus from a computer readable storage medium storing the program therein. A form of the computer readable storage medium can be any form as long as the computer readable storage medium can store programs and is readable by the apparatus such as a disk type ROM and a solid-state computer storage media. The functions obtained by installation or download in advance in this way can be realized in cooperation with an OS (Operating System) in the apparatus.

While certain embodiments have been described, these embodiments have been presented by way of example only, and are not intended to limit the scope of the inventions. Indeed, the novel printers, print systems and printing methods described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A printer, comprising:

an image forming unit configured to form, on a medium, an image from a temperature-sensitive ink whose color is changed depending on a temperature;

a coloring conversion unit configured to convert a coloring state of the image from the temperature-sensitive ink by heating or cooling the image of the temperature-sensitive ink;

a deterring unit provided between the coloring conversion unit and the image forming unit and configured to deter an air heated or cooled by the coloring conversion unit from flowing toward the image forming unit, and a visual recognition enabling unit configured to enable external visual recognition of the image of the temperature-sensitive ink formed on the medium and subjected to coloring state conversion in the coloring conversion unit.

2. The printer of claim 1, further comprising:

an electricity-removing unit provided in the deterring unit and configured to remove static electricity.

3. The printer of claim 2, wherein the deterring unit includes a blower unit configured to blow an air heated or cooled by the coloring conversion unit and a guide unit configured to guide the air blown by the blower unit so as not to flow toward the image forming unit.

4. The printer of claim 3, further comprising:

a control unit configured to switch operations of the coloring conversion unit and the blower unit to one of an intermittent operation and a continuous operation depending on an image formation interval in the image forming unit.

5. The printer of claim 3, further comprising:

a control unit configured to stop an operation of the blower unit if a specified time lapses after the coloring conversion unit is stopped.

6. The printer of claim 3, wherein the guide unit has an outlet through which the heated or cooled air is discharged outside of the guide unit, the electricity-removing unit provided in the outlet and configured to cause a part of the heated or cooled air to flow back into the guide unit and temporarily stay within the guide unit and to cause a part of the heated or cooled air to be discharged from the outlet to the outside of the guide unit.

7. The printer of claim 2, wherein the electricity-removing unit includes a plurality of electrically conductive fibers capable of air-discharging the static electricity and a support body configured to support the fibers.

8. The printer of claim 3, further comprising:

a conveying unit configured to convey the medium, the electricity-removing unit configured to remove static electricity charged in the medium conveyed by the conveying unit when the air blown by the blower unit is guided by the guide unit.

9. The printer of claim 1, wherein the deterring unit is configured to maintain a visually recognizable state in which the image of the temperature-sensitive ink formed on the medium is subjected to coloring state conversion in the coloring conversion unit so that the image can be visually recognized from the visual recognition enabling unit.

10. The printer of claim 9, wherein the deterring unit is made of a transparent material through which the image of the temperature-sensitive ink formed on the medium is subjected to coloring state conversion in the coloring conversion unit so that the image can be visually recognized from the visual recognition enabling unit.

11. The printer of claim 9, wherein the deterring unit has at least one opening through which the image of the temperature-sensitive ink formed on the medium is subjected to coloring state conversion in the coloring conversion unit so that the image can be visually recognized from the visual recognition enabling unit.

12. The printer of claim 1, further comprising:

a post-treatment device provided on a conveyance path at a downstream side of the coloring conversion unit in a medium conveying direction and configured to treat the medium conveyed along the conveyance path.

13. The printer of claim 12, further comprising:

a dew-removing member provided on a conveyance path at a downstream side of the post-treatment device in a medium conveying direction and configured to remove a moisture generated in the medium conveyed along the conveyance path by dew condensation in a coloring process of the medium.

14. The printer of claim 1, wherein the coloring conversion unit is a cooling device configured to cool the image formed by the image forming unit, and the deterring unit is configured to deter an air cooled by the cooling device from staying in a specific area.

15. A print system, comprising:

a printer including an image forming unit configured to form, on a medium, an image of a temperature-sensitive ink whose color is changed depending on a temperature;

a coloring conversion device including a coloring conversion unit configured to convert a coloring state of the image of the temperature-sensitive ink by heating or cooling the image of the temperature-sensitive ink and a deterring unit provided between the coloring conversion unit and the image forming unit and configured to deter an air heated or cooled by the coloring conversion unit from flowing toward the image forming unit;

and a visual recognition enabling unit configured to enable external visual recognition of the image of the temperature-sensitive ink formed on the medium and subjected to coloring state conversion in the coloring conversion unit.

16. The system of claim 15, wherein the coloring conversion device further includes a electricity-removing unit provided in the deterring unit and configured to remove static electricity.

17. A printing method, comprising:

conveying a medium to a image forming unit by a conveyance unit;

forming an image from a temperature-sensitive ink whose color is changed depending on a temperature on the medium by an image forming unit;

converting a coloring state of the image of the temperature-sensitive ink, which is formed on the medium, by cooling or heating the image of the temperature-sensitive ink by a coloring conversion unit;

guiding the air cooled or heated by the coloring conversion unit toward the conveyance direction of the medium by a deterring unit, and a visual recognition enabling unit configured to enable external visual recognition of the image of the temperature-sensitive ink formed on the medium and subjected to coloring state conversion in the coloring conversion unit.

18. The method of claim 17, further comprising:

removing static electricity of the air guided toward the conveyance direction of the medium by an electricity-removing unit.

* * * * *